US009848465B2

(12) United States Patent
Miles et al.

(10) Patent No.: US 9,848,465 B2
(45) Date of Patent: Dec. 19, 2017

(54) ELECTROLUMINESCENT DISPLAYS AND LIGHTING

(71) Applicant: DST INNOVATIONS LIMITED, London, Greater London (GB)

(72) Inventors: Anthony Miles, Glamorgan (GB); Robert Miles, Glamorgan (GB)

(73) Assignee: DST INNOVATIONS LIMITED, London (GB)

( * ) Notice: Subject to any disclaimer, the term of this patent is extended or adjusted under 35 U.S.C. 154(b) by 0 days.

(21) Appl. No.: 14/425,536

(22) PCT Filed: Sep. 3, 2013

(86) PCT No.: PCT/GB2013/052307

§ 371 (c)(1),
(2) Date: Mar. 3, 2015

(87) PCT Pub. No.: WO2014/033484

PCT Pub. Date: Mar. 6, 2014

(65) Prior Publication Data

US 2015/0257210 A1 Sep. 10, 2015

(30) Foreign Application Priority Data

Sep. 3, 2012 (GB) ..... 1215645.1

(51) Int. Cl.
*H05B 33/02* (2006.01)
*H05B 33/20* (2006.01)
*H05B 33/14* (2006.01)

(52) U.S. Cl.
CPC ..... *H05B 33/02* (2013.01); *H05B 33/14* (2013.01); *H05B 33/20* (2013.01)

(58) Field of Classification Search
CPC ..... H01L 25/048; H01L 27/3267; H01L 27/3286; H01L 51/5278; H01L 51/0059; H01L 51/0081; H01L 27/32; H01L 51/5036; H01L 51/5275; H05B 33/02; H05B 33/14; H05B 33/20
USPC ..... 313/498–512
See application file for complete search history.

(56) References Cited

U.S. PATENT DOCUMENTS

| | | | | |
|---|---|---|---|---|
| 2,838,715 A | | 6/1958 | Payne | |
| 3,023,338 A | | 2/1962 | Cerulli | |
| 3,201,633 A | | 8/1965 | Lieb | |
| 4,396,864 A | * | 8/1983 | Suntola et al. | 313/506 |
| 5,142,192 A | * | 8/1992 | Takahashi et al. | 313/506 |
| 6,054,809 A | | 4/2000 | Haynes et al. | |
| 6,144,156 A | | 11/2000 | Lutschounig et al. | |

(Continued)

FOREIGN PATENT DOCUMENTS

| | | |
|---|---|---|
| EP | 1383180 A2 | 1/2004 |
| EP | 1634697 A1 | 3/2006 |

(Continued)

*Primary Examiner* — Donald Raleigh
*Assistant Examiner* — Kevin Quarterman
(74) *Attorney, Agent, or Firm* — Morris & Kamlay LLP

(57) ABSTRACT

Embodiments of the present invention include: •electroluminescent layer constructions; •stacked or side-by-side arrangements of electroluminescent elements; and •color pixels, displays and light sources comprising multiple such arrangements. Embodiments of the invention may include touch sensitive, haptic and/or lenticular 3D features.

7 Claims, 34 Drawing Sheets

(56) References Cited

U.S. PATENT DOCUMENTS

| | | | | |
|---|---|---|---|---|
| 6,264,805 | B1 | 7/2001 | Forrest et al. | |
| 6,958,488 | B2 * | 10/2005 | Uchida | 257/40 |
| 8,093,823 | B1 | 1/2012 | Ivey et al. | |
| 2001/0020818 | A1 * | 9/2001 | Uchida et al. | 313/504 |
| 2002/0024298 | A1 | 2/2002 | Fukunaga | |
| 2002/0041153 | A1 | 4/2002 | Burrows | |
| 2003/0127989 | A1 | 7/2003 | Moser | |
| 2003/0218422 | A1 | 11/2003 | Park et al. | |
| 2004/0058615 | A1 | 3/2004 | Murasko et al. | |
| 2004/0160177 | A1 * | 8/2004 | Uchida et al. | 313/506 |
| 2004/0183434 | A1 * | 9/2004 | Yeh et al. | 313/506 |
| 2004/0227457 | A1 | 11/2004 | Yamashita | |
| 2004/0227462 | A1 | 11/2004 | Utsumi et al. | |
| 2005/0046799 | A1 * | 3/2005 | Pezzaniti | 353/10 |
| 2005/0104072 | A1 | 5/2005 | Slater et al. | |
| 2005/0110384 | A1 | 5/2005 | Peterson | |
| 2005/0179378 | A1 * | 8/2005 | Oooka et al. | 313/512 |
| 2006/0132028 | A1 | 6/2006 | Anderson | |
| 2006/0138948 | A1 | 6/2006 | Ray et al. | |
| 2006/0220534 | A1 * | 10/2006 | Shibanuma et al. | 313/504 |
| 2006/0228974 | A1 | 10/2006 | Thelss et al. | |
| 2006/0255717 | A1 | 11/2006 | Hartmann et al. | |
| 2007/0046187 | A1 | 3/2007 | Tsai et al. | |
| 2007/0083918 | A1 | 4/2007 | Pearce et al. | |
| 2007/0105005 | A1 | 5/2007 | Tolmachev et al. | |
| 2007/0114907 | A1 | 5/2007 | Chiang et al. | |
| 2007/0252524 | A1 | 11/2007 | Lee et al. | |
| 2007/0278943 | A1 * | 12/2007 | Hartmann et al. | 313/506 |
| 2007/0281375 | A1 | 12/2007 | Ibe et al. | |
| 2008/0036366 | A1 | 2/2008 | Yaegashi | |
| 2008/0116791 | A1 | 5/2008 | Kim | |
| 2008/0122347 | A1 | 5/2008 | Lee | |
| 2008/0246393 | A1 * | 10/2008 | Qiu et al. | 313/504 |
| 2009/0154310 | A1 | 6/2009 | Hotta et al. | |
| 2009/0206733 | A1 | 8/2009 | Hwang et al. | |
| 2010/0046210 | A1 | 2/2010 | Mathai et al. | |
| 2010/0133998 | A1 | 6/2010 | Nishikawa et al. | |
| 2010/0141123 | A1 | 6/2010 | Joo et al. | |
| 2011/0037729 | A1 | 2/2011 | Cho et al. | |
| 2011/0068330 | A1 | 3/2011 | Akimoto et al. | |
| 2011/0117814 | A1 | 5/2011 | Norman et al. | |
| 2011/0204343 | A1 | 8/2011 | Birnstock et al. | |
| 2011/0248244 | A1 | 10/2011 | Ali et al. | |
| 2012/0205684 | A1 | 8/2012 | Yamazaki et al. | |

FOREIGN PATENT DOCUMENTS

| | | | |
|---|---|---|---|
| EP | 1940202 | A1 | 7/2008 |
| EP | 2133854 | A1 | 12/2009 |
| EP | 2285185 | A1 | 2/2011 |
| EP | 2455994 | A1 | 5/2012 |
| EP | 2487719 | A2 | 8/2012 |
| GB | 2426856 | A | 12/2006 |
| JP | 06104087 | A | 4/1994 |
| JP | 2002008870 | A | 1/2000 |
| JP | 2004349064 | A | 12/2004 |
| JP | 2005108516 | A | 4/2005 |
| JP | 2006190536 | A | 7/2006 |
| JP | 2007073403 | A | 3/2007 |
| JP | 2009070995 | A | 4/2009 |
| JP | 2009289742 | A | 12/2009 |
| JP | 2010003547 | A | 1/2010 |
| WO | WO-2005104072 | A1 | 11/2005 |
| WO | WO-2007083918 | A1 | 7/2007 |
| WO | WO-2007105005 | A1 | 9/2007 |
| WO | WO-2009154310 | A1 | 12/2009 |
| WO | WO-2010034280 | A2 | 4/2010 |
| WO | WO-2011117814 | A1 | 9/2011 |

* cited by examiner 1
8
2
3
2
3
2
3

ELECTROLUMINESCENT DISPLAYS AND LIGHTING

FIELD OF THE INVENTION

This invention relates to electroluminescent display and/or lighting apparatus.

BACKGROUND OF THE INVENTION

Electroluminescent (EL), Organic Light Emitting Diode (OLED), and light emitting polymers are known. One early example of an EL capacitor is disclosed in U.S. Pat. No. 3,201,633.

SUMMARY OF THE INVENTION

Aspects of the invention are defined in the accompanying claims.

Embodiments of the invention include methods of using electroluminescent (EL) coatings in specific configurations that improve specific aspects of their performance when used as digital display units, individual light emitting indicators, light emitting elements, or as general lighting, whether direct or diffuse.

Embodiments of the invention include the configuration of UV EL material and UV phosphors, where UV EL material or any other UV light source are used to illuminate UV reactive luminescent phosphor and other such light emitting and converting substances to create light of varying colours and intensities.

Embodiments of the invention include methods of using electronics to address the colour elements (pixels) and (sub-pixels) in a manner that will produce digital images both in 2D, 3D and volumetrically.

Embodiments of the invention may include one or more touch sensitive surfaces.

Embodiments of the invention include the use of electroluminescent (EL) and ultraviolet (UV) luminescent materials, in specific constructions and layered formulations, to increase the ability of such light emitting devices to output more light per area, be more robust and flexible in applications and be much more deeply integrated with interactive surfaces, while at the same time not having the interactive surfaces obscure the output of light from the light emitting elements.

Embodiments of the invention may use specific configurations and constructions of layers to greatly increase the performance of EL and UV luminescent materials by increasing their longevity. These specific configurations may increase the robustness of the electroluminescent and ultraviolet luminescent materials so that they can be employed in display applications that are typically harmful to currently available display units.

Embodiments of the invention may use specific configurations of layers to create surfaces that are able to display digital images that are non-uniform in their nature and/or to create such display units configured specifically to reflect the image generated by the display onto a reflective surface such as, but not restricted to, plastic, glass and metals.

BRIEF DESCRIPTION OF THE DRAWINGS

There now follows, by way of example only, a detailed description of embodiments of the present invention, with reference to the figures identified below.

DETAILED DESCRIPTION OF EMBODIMENTS OF THE INVENTION

Electroluminescent Elements

Figure 1:
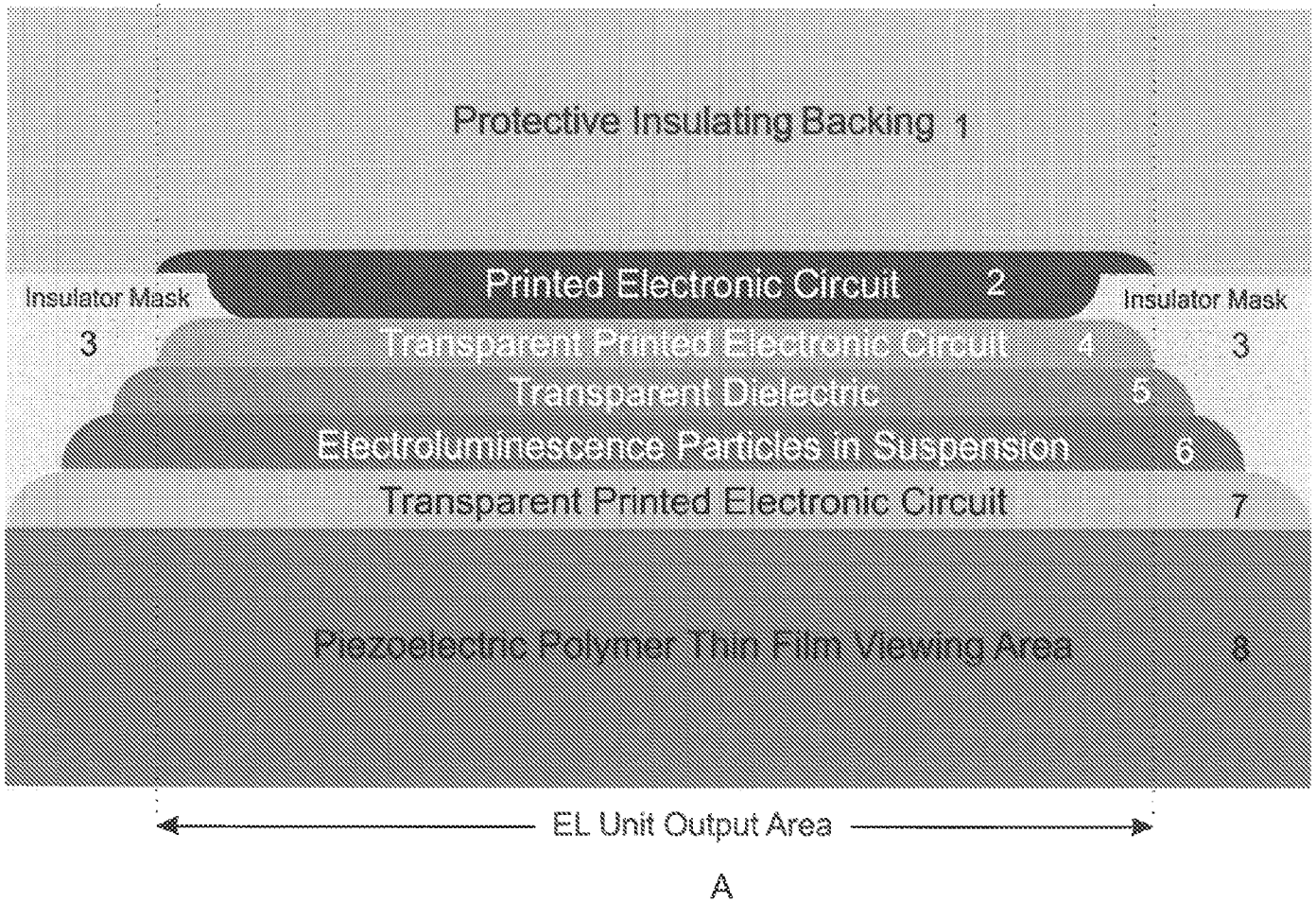
FIG. 1 is a schematic cross-sectional diagram of an electroluminescent element in an embodiment.

FIG. 1 is a cross sectional diagram illustrating the different layers of an electroluminescent element in an embodiment of the invention. The element comprises the following layers, in order: a protective insulating substrate or backing 1, a printed electronic circuit layer 2, a first transparent printed electronic circuit layer 4, a transparent dielectric layer 5, an electroluminescent layer 6, comprising for example electroluminescent particles in suspension, a second transparent printed electronic circuit layer 7, and a cover layer 8, comprising for example a piezoelectric material such as a polymer thin film, through which light is output over an output area A.

A process and materials for manufacture of the electroluminescent element will now be described.

A transparent piezoelectric polymer substrate is manufactured to a specification that prevents it from substantially expanding or shrinking when subjected to heating and cooling processes, some of which may be rapid in nature, and is prepared for coating. Other formulations of transparent substrates that exhibit the same or similar properties may be used provided they have the ability to maintain the integrity of the electronic circuit and its printed or placed electronic components while subjected to the manufacturing process. This transparent piezoelectric polymer substrate will then be used as the cover layer 8 that will become the front of the display when completed. This property of the transparent piezoelectric polymer substrate is important for the laying down of conductive compounds in an accurate manner, then ablating areas of the conductive materials to create electronic circuits and components and then mask alignment for further material deposition after the first processing stages.

The transparent piezoelectric polymer substrate is then coated with a transparent conductive compound. The conductive compound is ablated to produce the electronic circuit layer 7 that will form one side of the light emitting unit's electrical contact and form locations for electronic components that will be deposited onto the substrate later.

The finished electronic circuit layer 7 is then cleaned and subjected to a heating and cooling process that has a further effect on the conductive coating that makes up the electronic circuits. Through the process the conductive coatings will become extremely flexible and their ability to perform as electronic circuits will be enhanced.

The electroluminescent particles are suspended in a solution that enables them to adhere to the transparent piezoelectric polymer substrate 7, 8 at the circuit junctions etched in the conductive coating. The electroluminescent particles in their suspension will remain flexible when dry. The electroluminescent particles are then deposited onto the junctions, forming the electroluminescent layer 6. The coated substrate is then passed once more through the heating process and cooled at a specific rate. The heating and cooling process is critical for maintaining the flexibility of the electroluminescent particles in suspension.

A transparent or light-transmissive dielectric compound is then laid over the top of the electroluminescent layer 6 in a fractionally smaller area than the electroluminescent layer 6, to form transparent dielectric layer 5. In cases where the dielectric is required to have either light reflective or absorbent properties, pigment may be added to the dielectric to create the desired effect. In a situation where this is needed, care must be taken to maintain the dielectric constant. The dielectric compound may be laid over the electroluminescent layer 6 as a coating and then ablated later. This configuration will enhance the performance of the light emitting unit and help to maintain its electrical integrity when flexed or formed into shapes. The layers are then heated and cooled at a specific rate and temperature to ensure that they bond correctly, maintain their electrical performance and their flexible properties. The dielectric process may be repeated, depending on the design output needs.

A transparent conductor is then deposited on the top of the dielectric 5, to form the first transparent printed electronic circuit layer 4. This conductor is deposited to form a circuit which will contain a number of electronic components and connections to the light emitting elements. If the dielectric 5 is laid on the phosphors in a sheet or coat form, the transparent conductive surface may be already on the sheet or deposited with the dielectric coating at the same time. The transparent conductor is then heated and cooled to improve its flexibility, durability and electrical performance.

An insulation mask 3 is then deposited around the finished elements to protect the element.

Finally, a second transparent conductor is deposited, making up the last section on the electronic circuit, to form printed electronic circuit layer 2. The unit is then heated up one more time before it is rapidly cooled and sealed with an insulating backing sheet 1 of polymer. The insulating backing polymer may be coated with a reflective coating or layer designed to direct the light forward to the viewing area of the cover layer 8. This reflective layer may not be needed if the dielectric has already been treated with a pigment that has the properties needed to reflect the light.

The insulating backing polymer 1 may be made up of a capacitive, resistive or other type of touch-sensitive panel, and may be coated with a reflective coating designed to direct the light forward to the viewing area. This will have a number of advantages. Firstly, the touch panel and its conductive coatings will not obscure the viewing panel as the light emitting elements will be over the top of the touch panel and not behind it. The extremely thin light emitting panel will not obstruct the function of the touch panel. As touch panels are not totally transparent, having them in front of the light emitting elements subtracts from their total possible light output. Traditional digital display screen constructions do not typically enable the touch panel to be placed behind the substrate with the light emitting elements. This means that light output from the traditional types of digital flat panels with touch surfaces is lost. The inevitable outcome of this is that more light output must be obtained from the traditional digital display panel to compensate for the loss, meaning that there is a consumption of more power.

The configuration of this embodiment may provide improved performance and reliability. Alternatively or additionally, the configuration of this embodiment may enable piezoelectric effects in the electroluminescent particles and the piezoelectric polymer to create a haptic function, as follows.

In one approach, a first haptic overlay is made up of a matrix of small indents that are embossed in a transparent polymer which has a corresponding conductive circuit on the side that is also embossed. The indentations are then filled with a clear liquid that rapidly expands and contracts when an electrical charge is applied to it. A thick transparent film with the second electronic circuit is then placed over the embossed area sealing the fluid between the two layers. When the matrix is addressed with an electrical charge the fluid between the layers rapidly expands and contracts, creating a sensation of texture. The rapid expansion and contraction is localised to the area where tactile feedback is needed, and is in fact a form of in and out movement analogous to the movement of an audio speaker. The deformation of the surface is very small but very apparent to the touch.

A second approach is similar to the first in terms of the structure of the matrix with the exception of the embossing and the liquid. The first thin film substrate is coated with a transparent conductor which is then processed into an electronic circuit. Then a second piezoelectric polymer is placed over the electronic circuit sticking to the electronic contacts. The piezoelectric polymer is then cut, leaving a piezoelectric polymer shape behind. A thin film substrate with a conductive electronic circuit is then placed over the piezoelectric polymer. When an electric signal is applied the movement is analogous to the movement of an audio speaker.

Figure 2A:
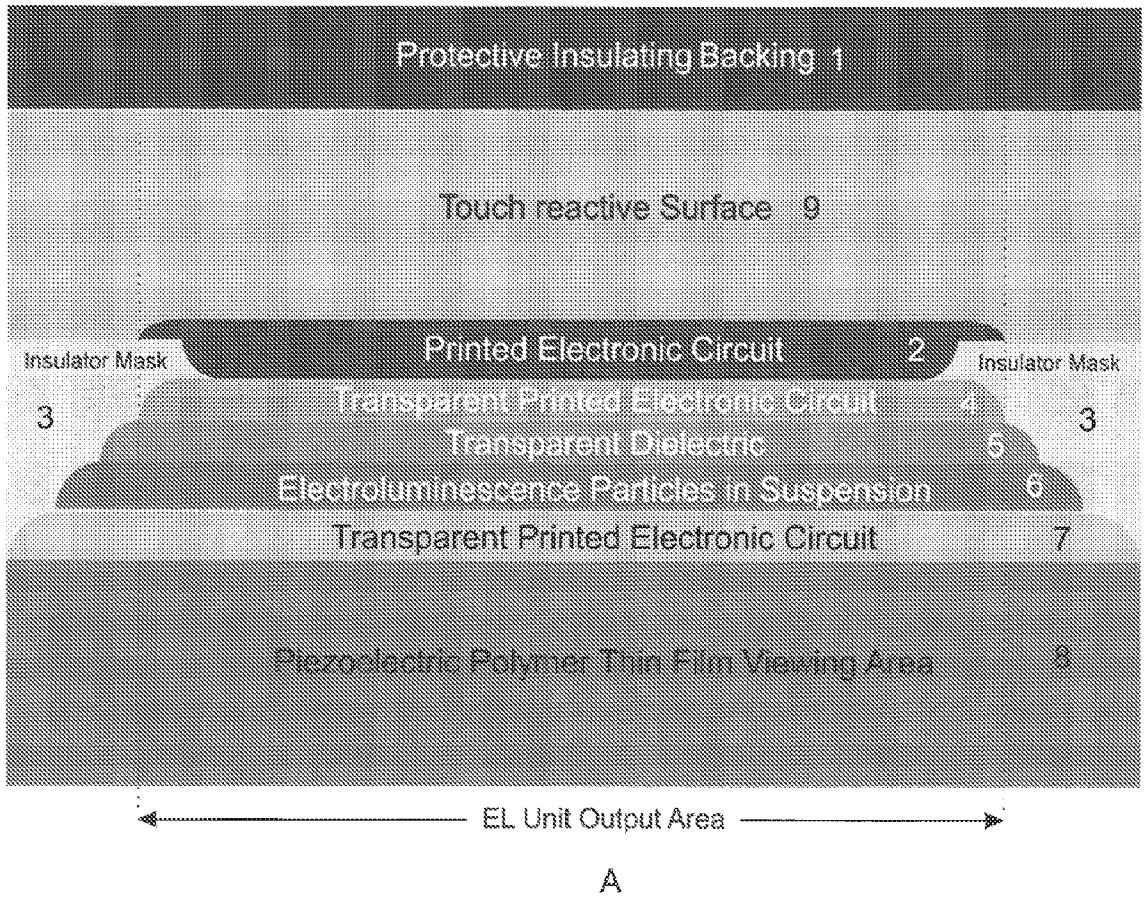
FIG. 2*a* is a schematic cross-sectional diagram of an electroluminescent element in another embodiment.

FIG. 2*a* is a cross sectional diagram illustrating the different layers of an electroluminescent element in another embodiment similar to that of FIG. 1, but including a touch sensitive or reactive layer 9 is located between the protective insulating substrate 1 and the first printed electronic circuit layer 2. The touch reactive layer 9 may be deposited on the substrate 1 and the construction then proceeds as in the FIG. 1 embodiment.

Figures 2B, 2C:
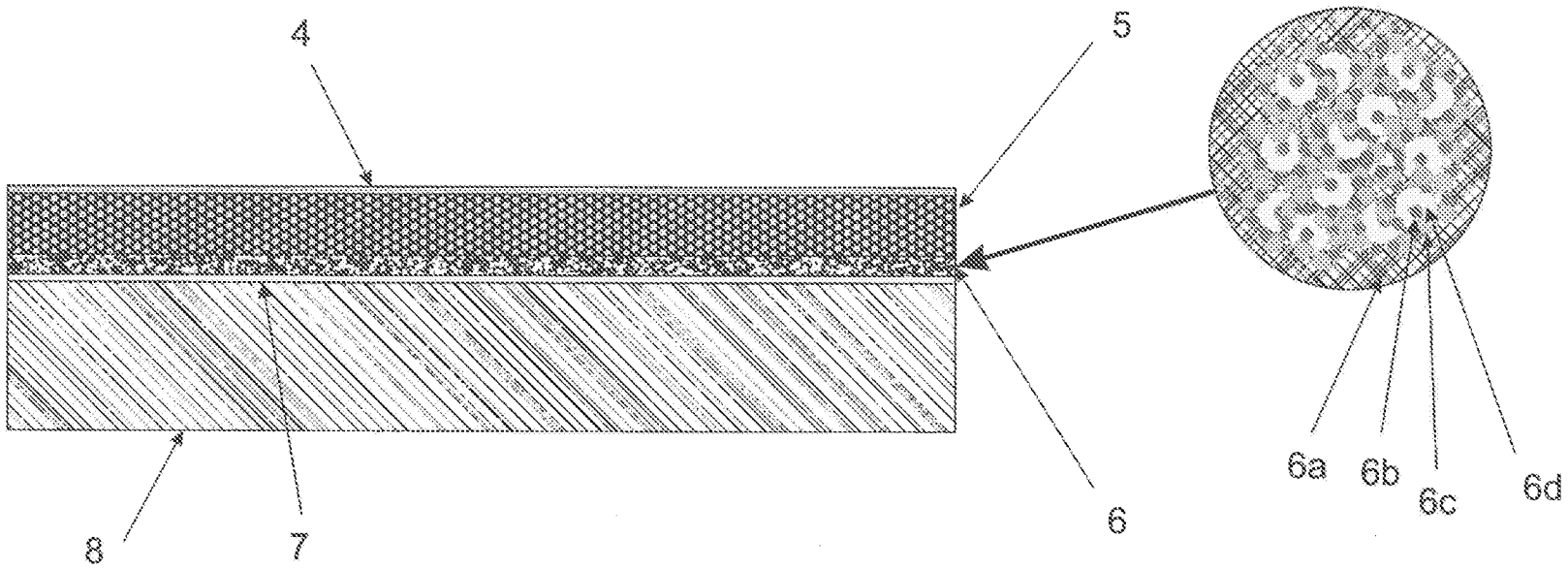
FIG. 2*b* is a schematic cross-sectional diagram of an electroluminescent element in another embodiment.
FIG. 2*c* is a partial plan view of the electroluminescent layer of the embodiment of FIG. 2*c*.

FIGS. 2*b* and 2*c* show an electroluminescent element in an alternative embodiment in which the electroluminescent layer 6 comprises a plurality of components in a single layer. The construction of the electroluminescent layer 6 in this embodiment is applicable to any of the other embodiments disclosed herein.

The element comprises the following layers: a piezoelectric substrate 8, a transparent printed electronic circuit layer 7, an electroluminescent layer 6, a transparent dielectric layer 5, and a second electronic circuit layer 4. The backing layer 1 may optionally be provided on the second electronic layer 4, or some other protective means may be provided as part of the integration of the element into a device.

FIG. 2*c* shows an enlarged view of the electroluminescent polymer compound, showing a binder 6*a*, reflective insulator and spacer particles 6*b*, light frequency modification particles 6*c*, and phosphor particles 6*d*.

Where specific details are not provided in this section, the processes and materials used for the manufacture of the electroluminescent element is substantially similar to those described in the previous embodiment.

Due to its physical properties, piezoelectric material is the preferred material for the substrate 8. Specifically, it is of a high level of transparency, whilst also being resistant to deformation when subjected to manufacturing processes such as heating, as will be required in the manufacture of the electroluminescent element. The piezoelectric material may be PZT (lead zirconate titanate). In alternative embodiments, other substrates such as PET (Polyethylene terephthalate) could be used. However, the use of piezoelectric material or polymer is advantageous for construction of the electroluminescent element. It is important that the substrate 8 remains flat and as close to the starting dimension as possible throughout the construction steps. Soft piezoelectric polymer based on materials such as PZT are pre-stressed and therefore do not deform to the same extent as material such as PET when subjected to large swings in temperature, the application of high pressure and/or tension applied, for example when being pulled in a roll-to-roll process. Also, the piezoelectric polymer has an extremely efficient dielectric property and acts as a very good insulator.

The transparent printed electronic circuit layer 6 is formed as a conductive material coating that can be either largely transparent, or patterned in such a way that it is optically insignificant or imperceptible when the device is in use.

The transparent dielectric layer 5 can be made from any dielectric of the correct dielectric specification. In alternative embodiments, a non-transparent dielectric of a high reflective index may be used.

The second electronic circuit layer 2 is similar to that of printed electronic circuit layer 2 in FIG. 1, and shall not be further described here.

In a particular embodiment, the electroluminescent layer 6 comprises a polymer made of a mixture of phosphor particles 6*d* that are manufactured to be at least predominantly of a specific dimension, and are doped such that when the system is in operation, the particles emit light at frequencies necessary to produce the desired output colours. The phosphor particles 6*d* may be of the Quantum Dot (QD) type, or of the 0.5 to 14 micron type.

The binder 6*a* is a compound that is able to act as a carrier for the particles, binding them together to allow them to be printed onto the substrate 8. The reflective insulator and spacer particles 6*b* serve three important functions; to mix and reflect the light frequencies produced by the light emitting particles 6*d* to ensure that the resultant light frequency is of the required type, to create a space between the light emitting particles 6*d* to assist in the production light output, and to protect the light emitting particles 6*d* from being subjected to harmful drive conditions, thus advantageously increasing the longevity of the device. The light frequency modification particles 6*c* can be of any substance that is capable of reflecting and filtering the light that is being outputted by the light emitting particles 6*d*, thus changing the light frequency to the frequency that is specific to the application of the system at the time.

Co-Planar Construction

Figure 3:
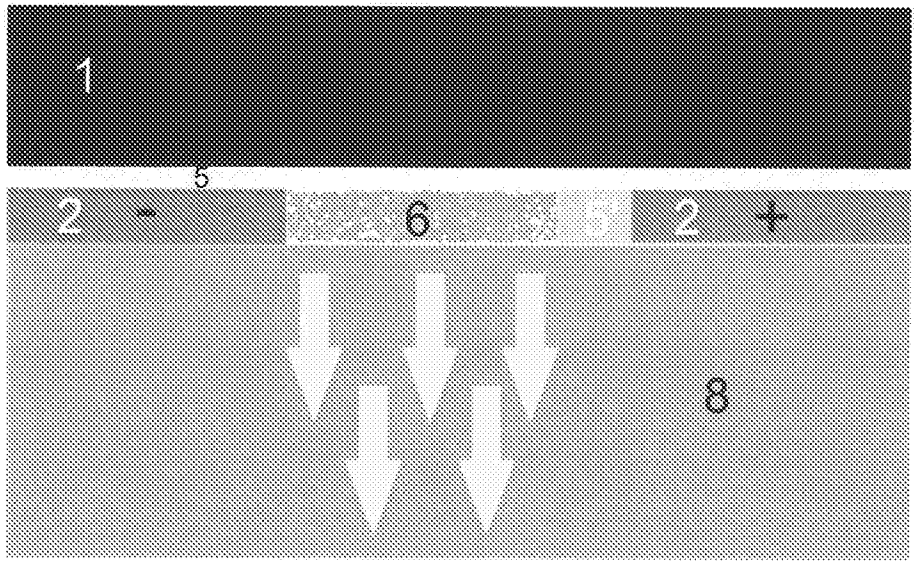
FIG. 3 is a schematic cross-sectional diagram of an electroluminescent element in another embodiment, with a co-planar construction.

An alternative, co-planar construction of an electroluminescent element or capacitor is shown in FIG. 3, in which all or at least some of the components are laid on to a substrate in an interlocked, side-by-side configuration. The arrangement comprises insulating back substrate 1, conductive contacts 2 that connect to the matrix of elements, dielectric 5', electroluminescent layer 6, transparent insulator 5, and front substrate/viewing area 8. As can be seen from the figure, the conductive contacts 2, dielectric 5' and electroluminescent layer 6 are substantially coplanar.

Figure 4:
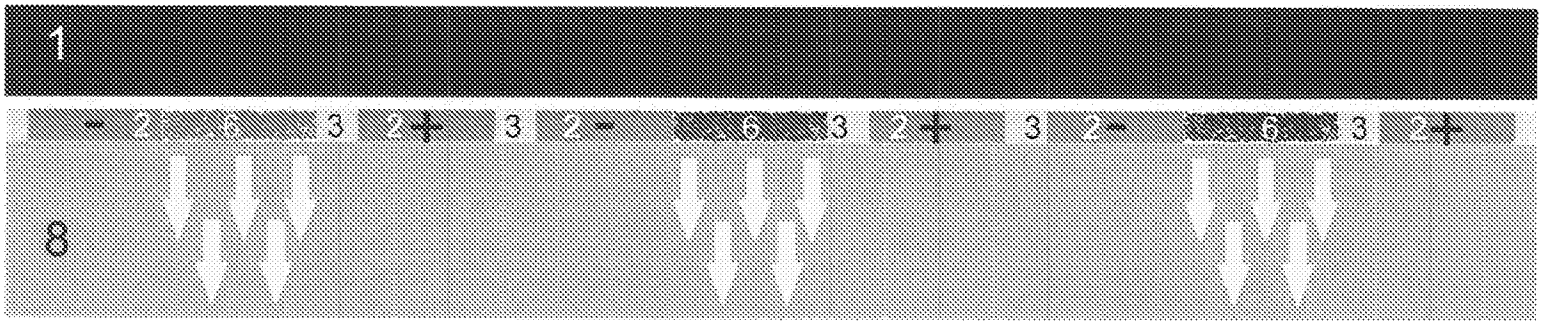
FIG. 4 is a schematic cross-sectional diagram of a plurality of electroluminescent elements of FIG. 3, arranged as sub-pixels of a colour pixel.

As shown in FIG. 4, the co-planar capacitors/elements can be laid down onto the viewing substrate 8 as sub-pixels in an RGB configuration that can be used to produce a colour pixel. The sub-pixel elements can be addressed in an active or passive matrix system.

Figure 5:
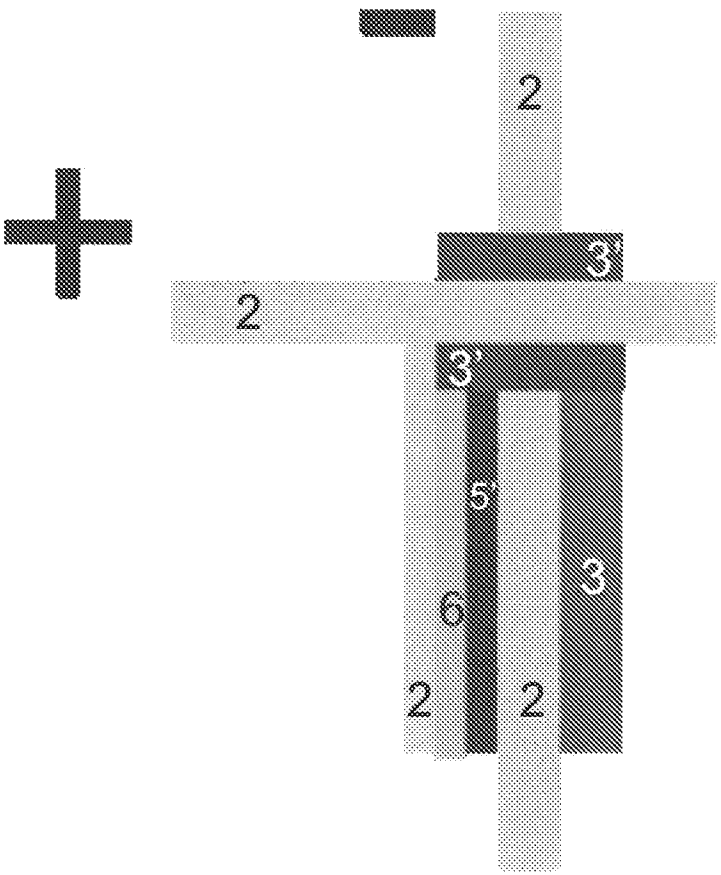
FIG. 5 is a schematic plan view of an electroluminescent element of FIG. 3.

FIG. 5 is a plan view of a co-planar construction of a light emitting capacitor/element comprising positive and negative conductors 2 used to connect the unit to a driver circuit (not shown). The construction of driver circuits is well known in the art. An insulator compound 3 used to isolate the individual units. An insulating compound 3' is used to isolate the conductors 2 for the x and y circuits.

In this construction all the components of the light emitting capacitors are deposited on a transparent substrate 8. In other cases the substrate 8 may not be transparent and the covering substrate 1 may be the only outlet for the light emitted from the unit.

Figure 6:
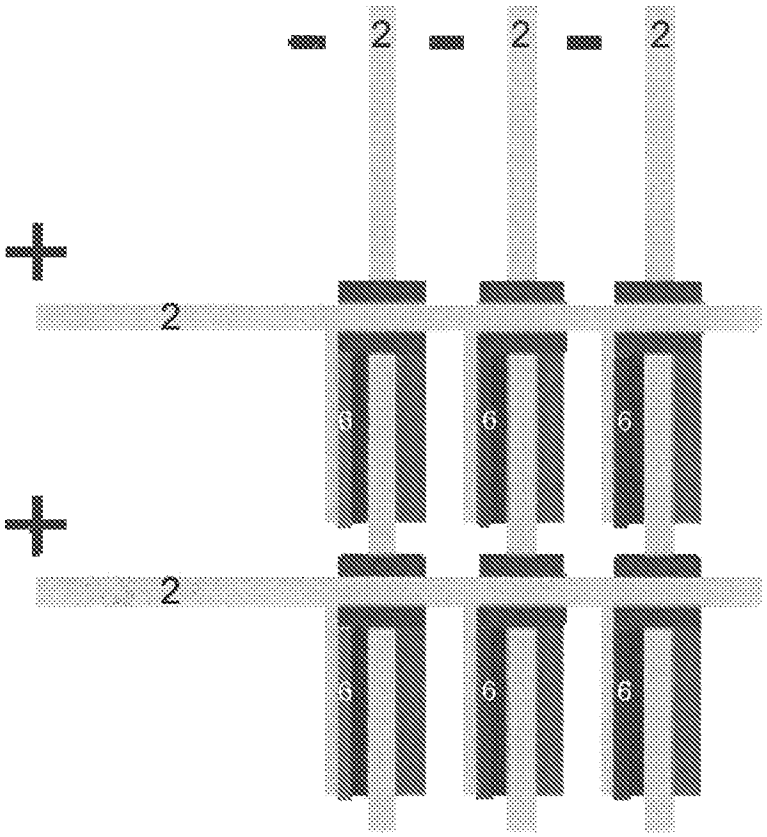
FIG. 6 is a schematic plan view of a plurality of electroluminescent elements each as shown in FIG. 5, arranged as sub-pixels of a colour pixel.

FIG. 6 shows the co-planar matrix construction of a plurality of the elements of FIG. 5. By configuring light-emitting co-planar capacitors in an active or passive matrix on the surface of a substrate in RGB groups, pixels can be formed and many colours and pictures can be displayed. Depending on the properties of the substrate the display that can be formed can be flexible or not, transparent or not, thick or thin and so on.

Figure 7:
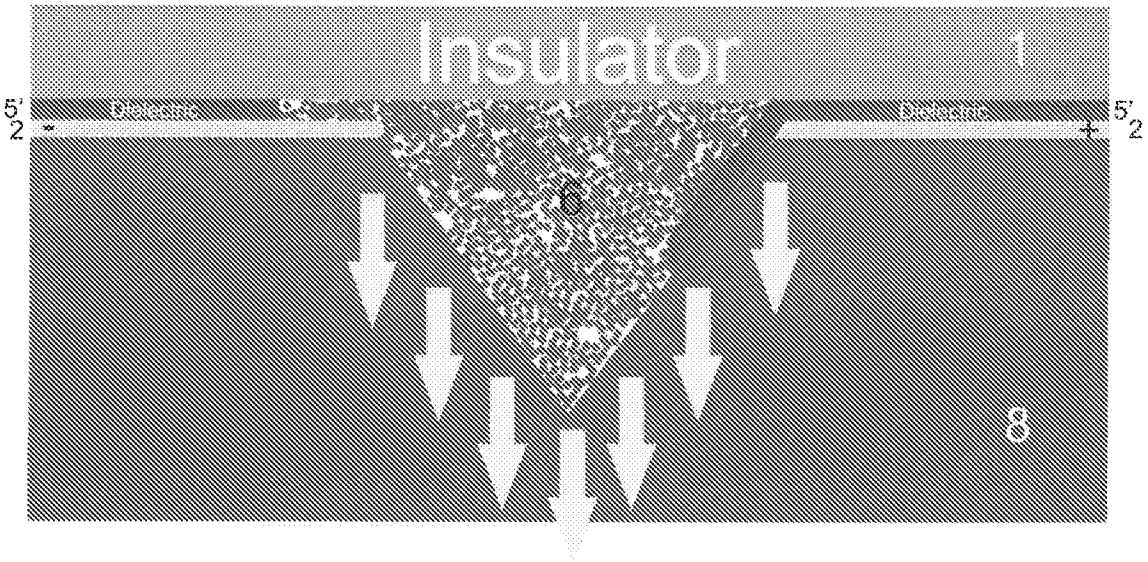
FIG. 7 is a schematic cross-sectional diagram of an electroluminescent element in another embodiment, with a co-planar and cavity construction.

FIG. 7 shows a co-planar light emitting capacitor where the electroluminescent material 6 and a proportion of the conductors 2 and dielectric 5' are contained within a cavity or trench that is pre-formed in the viewing substrate 8. The conductors 2 and the dielectric layers 5' may be laid onto the substrate 8 before the cavity is formed and then filled with the electroluminescent material 6. The cavity is shown as V-shaped in cross-section, but this is only by way of example and the shape of the cavity will depend on the needs of the light emitting capacitor.

Figure 8:
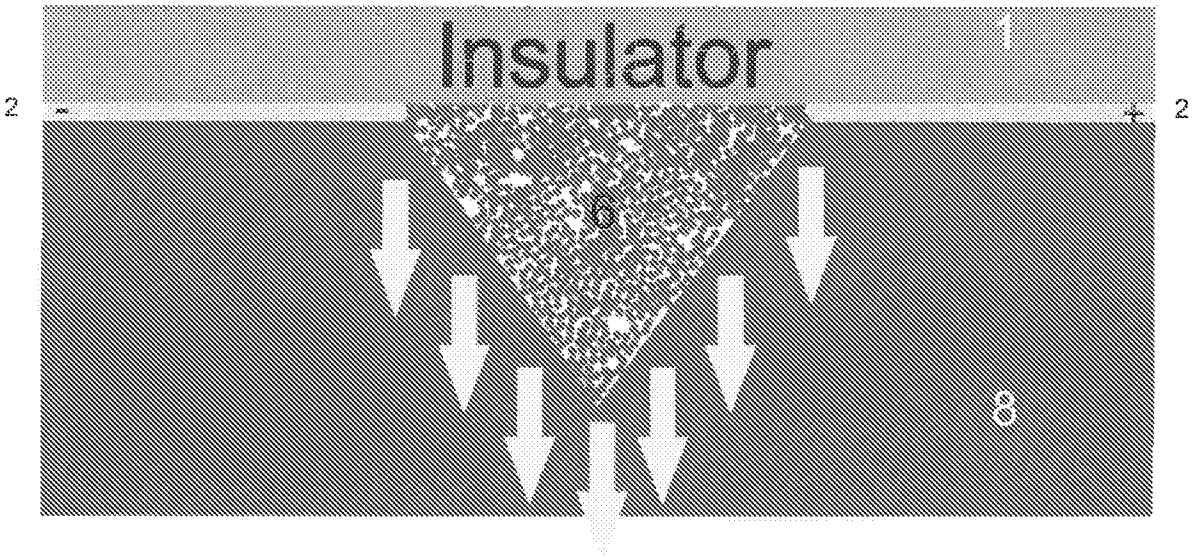
FIG. 8 is a schematic cross-sectional diagram of an electroluminescent element in a variant of the embodiment of FIG. 7.

FIG. 8 shows an alternative construction to that of FIG. 7, in which both conductors 2 are placed in contact with the electroluminescent material 6 on the either side of the cavity. The construction of the electroluminescent material 6 in the cavity forms a configuration that creates a dielectric effect, eliminating the need to add a separate dielectric. The insulator 1 at the back of the unit is to protect the contacts 2 from short circuits.

Figure 9:
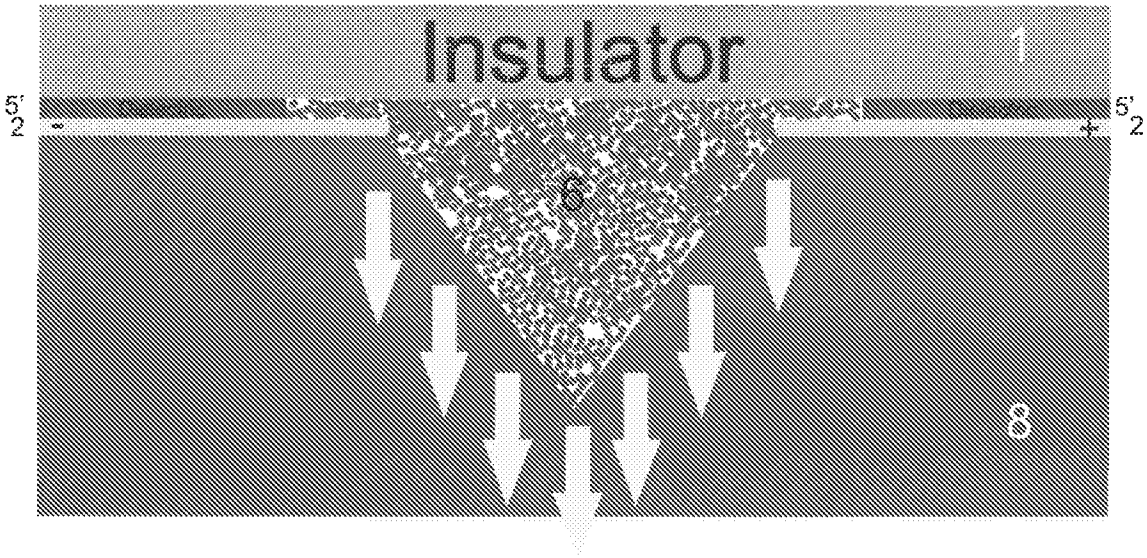
FIG. 9 is a schematic cross-sectional diagram of an electroluminescent element in another variant of the embodiment of FIG. 7.

FIG. 9 shows another alternative construction to that of FIG. 7, wherein the electroluminescent material 6 and a proportion of the conductors 2 and dielectric 5' are contained within a cavity that is pre-formed in the viewing substrate 8. In this construction a proportion of the electroluminescent material 6 is permitted to make contact with both conductors 2.

Figure 10:
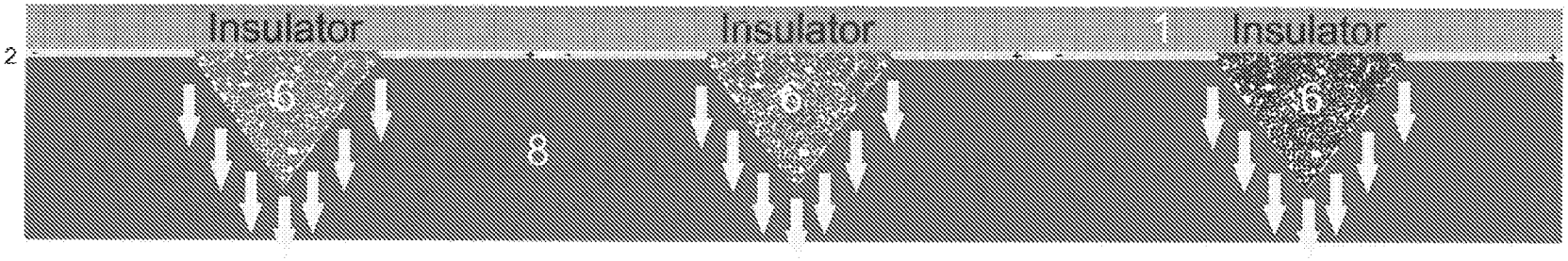
FIG. 10 is a schematic cross-sectional diagram of a plurality of electroluminescent elements of FIG. 7, or the variant of FIG. 8 or 9, arranged as sub-pixels of a colour pixel.

FIG. 10 illustrates multiple elements as disclosed in any one of FIGS. 7 to 9, with multiple cavities are arranged together and filled with electroluminescent material 6 to create sub-pixels that each emits a respective different colour from a group such as RGB, or emits light that is changed in some way to that respective colour, for example by fluorescence, so as to form a colour pixel. In this event, each sub-pixel would be addressed individually, either by active or passive methodologies.

Figure 11:
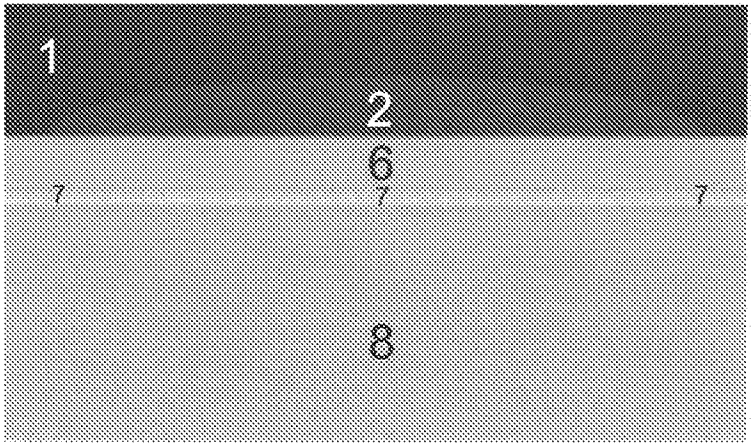
FIG. 11 is a schematic cross-sectional diagram of an electroluminescent element in another embodiment.

FIG. 11 shows another co-planar construction of a light-emitting element or capacitor, comprising insulator 1, conductor 2, electroluminescent material 6, conductor 7 and transparent substrate 8. This construction emits light in the same way as an element that incorporates the dielectric. However, it does not use a separate dielectric layer: the substrate 8 forms the dielectric in this case. The inventors have observed that by placing a contact on the conductor 2 and a contact directly on the electroluminescent material 6, the electroluminescent material 6 acts as it would in a traditional construction using a dielectric. In this embodiment, the conductor 2 extends into the insulator 1.

Figure 12:
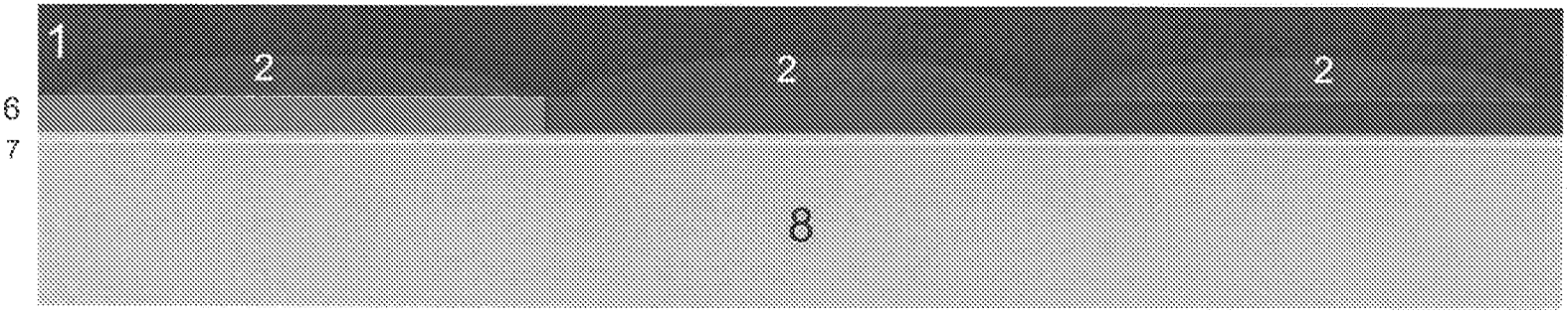
FIG. 12 is a schematic cross-sectional diagram of a plurality of electroluminescent elements of FIG. 11, arranged as sub-pixels of a colour pixel.

FIG. 12 shows multiple elements as disclosed in FIG. 11, arranged to create sub-pixels that each emits a respective different colour from a group such as RGB, or emits light that is changed in some way to that respective colour, for example by fluorescence, so as to form a colour pixel. In this event, each sub-pixel would be addressed individually, either by active or passive methodologies.

Increased Light Output—Stacked Layers

The following sections describe embodiments for increasing the light output of organic and non-organic electroluminescent light emitting elements incorporating, in some cases, the use of UV reactant phosphors to produce additional photonic changes. Other embodiments may include the stacking of other electroluminescent light emitting systems that may constitute alternative and/or additional layers making up the active luminescent elements. The stacking of the EL elements multiplies the surface area multiplying the light output by the number of layers, less the losses imposed on the layer by the fact that they are not totally transparent.

The layers may be addressed separately to add additional control to the input and output of the individual units. A suitable method of construction may be used to negate interaction between the layers.

Figure 13A:
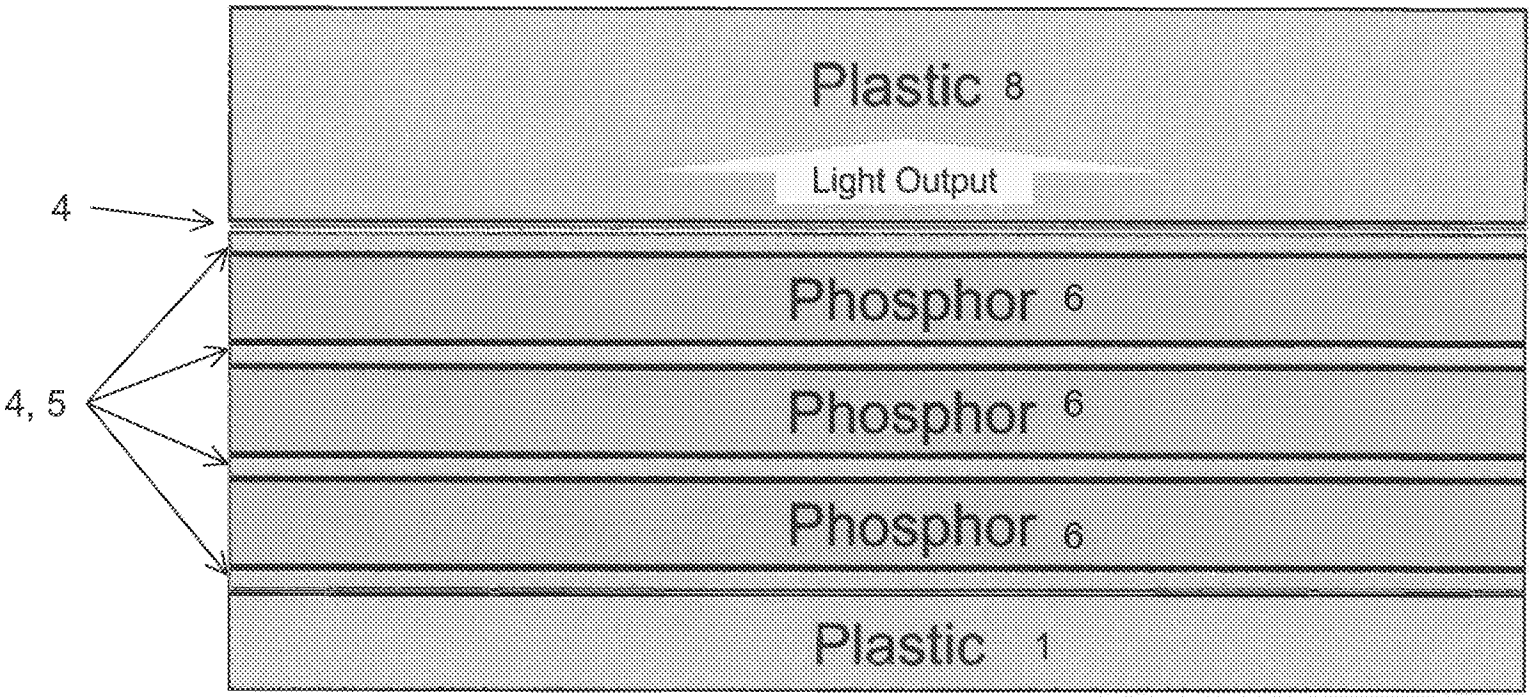
FIG. 13*a* is a schematic cross-sectional diagram of an electroluminescent element according to another embodiment.

In an embodiment shown in FIG. 13*a*, the element comprises a plurality of electroluminescent layers 6 stacked one on top of the other, separated by dielectric layers 5 each having a transparent conductive layer 4 on one side, and sandwiched between plastic substrate layers 1. The transparent conductive layers 4 may comprise for example Indium Tin Oxide (ITO).

The embodiment of FIG. 13*a* may be constructed in the following way, although other methods of achieving the same results may be possible. The construction of the multilayer light emitting capacitor element of FIG. 13*a* is largely the same as described in the construction of the elements in FIG. 1 or 2, with the addition of a process that brings the two or more of the layers together to form the stack. A similar construction may be applied to the embodiments of FIGS. 3 to 12. Each layer can be controlled individually or as a single unit. Material may be added to eradicate capacitive interaction between layers without substantially affecting their overall transparency, although some losses are inevitable.

Figure 13B:
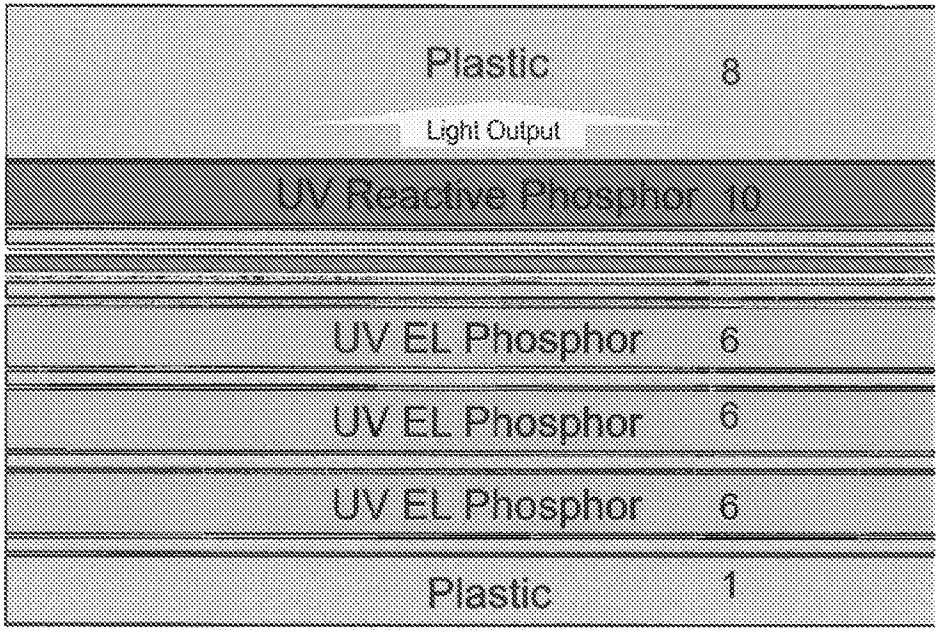
FIG. 13*b* is a schematic cross-sectional diagram of an electroluminescent element according to a variant of the embodiment of FIG. 13*a*.

In a variant of this embodiment, as shown in FIG. 13*b*, each of the electroluminescent layers 6 comprises a UV electroluminescent layer, and a UV reactive phosphor or fluorescent layer 10 emits visible light in response to absorption of UV light from the UV electroluminescent layers 6.

Between the UV electroluminescent layers 6 and the UV reactive phosphor layer 10 is a thin film substrate with a conductive circuit on two sides, a layer of liquid crystal that is specifically designed to block only UV light, then a second thin film substrate with a conductive circuit on two sides.

The UV electroluminescent layers 6 may be switched on and off in synchronisation with the change of state of the liquid crystal. When UV light is allowed to pass through to the UV reactive phosphor coating 10, the UV light is converted to visible light of the required colour and brightness.

Switching the UV light elements on only when needed greatly improves both the energy consumption and the contrast of the picture being created by the blending of the light from the RGB colours.

Figure 14:
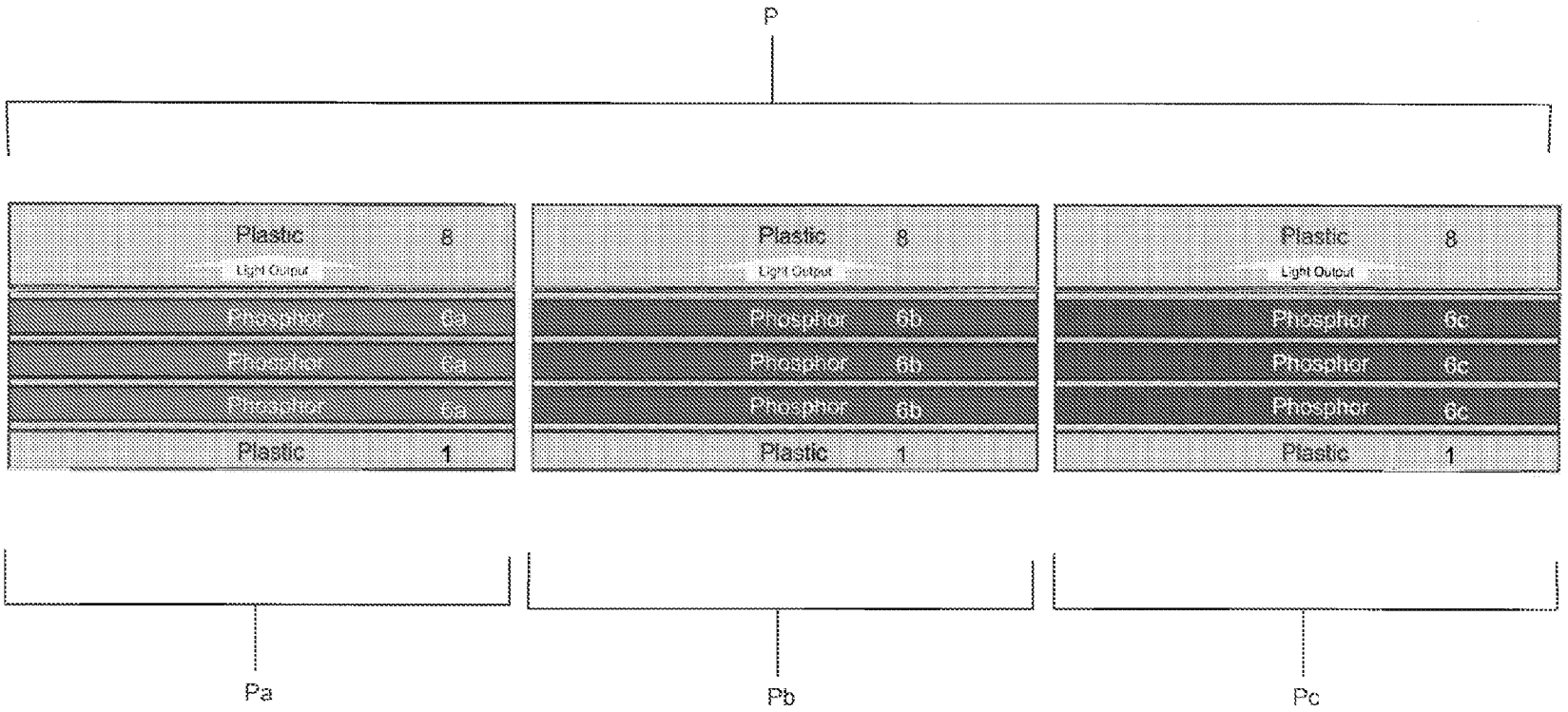
FIG. 14 is a schematic cross-sectional diagram of an electroluminescent colour pixel according to another embodiment.

Another embodiment shown in FIG. 14 comprises a coplanar group of elements as in FIG. 13, each of the elements within the group comprising respective electroluminescent layers 6*a*, 6*b*, 6*c* arranged to emit different colours, such as red, green or blue. Hence, the group comprises a colour pixel P, with each element within the group comprising a sub-pixel Pa, Pb, Pc. A plurality of the colour pixels may be provided in an addressable matrix, so as to provide a digital colour display.

Using an electronic address system to individually address the sub pixels in the pixel configuration and also addressing the stacked layers in the sub pixel stack, the amount of light can be precisely controlled and the colour output of the individual pixels can also be precisely controlled.

As described above, the stacking of the EL elements multiplies the light output by the number of layers, less the losses imposed by absorption or obstruction of light by the layers.

Figure 15:
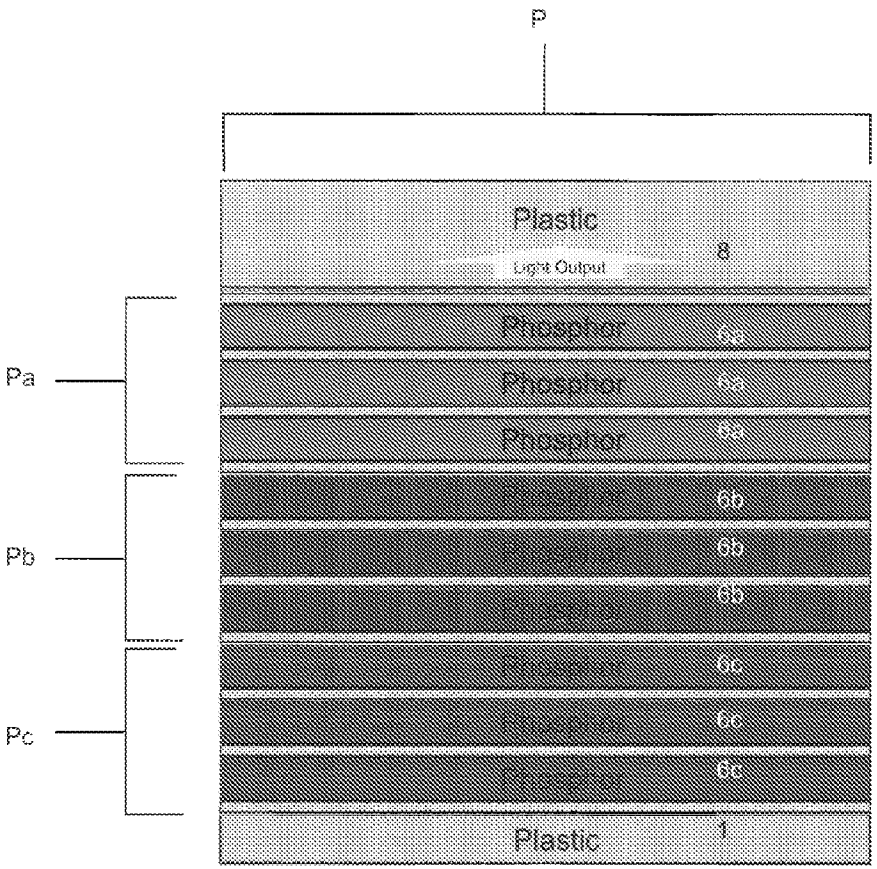
FIG. 15 is a schematic cross-sectional diagram of an electroluminescent colour pixel according to another embodiment.

Another embodiment shown in FIG. 15 comprises a stacked group of elements as shown in FIG. 13, each of the elements within the group comprising respective electroluminescent layers 6*a*, 6*b*, 6*c* arranged to emit different colours, such as red, green or blue. Hence, the group comprises a colour pixel P comprising stacked subpixels Pa, Pb, Pc, each comprising a plurality of stacked electroluminescent layers 6*a*, 6*b*, 6*c*. Stacking the EL layers in this manner negates the need to lay the colour elements that constitute the sub pixels side by side, therefore greatly increasing the number of pixels that can be placed together in an addressable form to constitute a digital display.

The red EL layers 6*a* may be towards the front of the viewing area, as red is the colour that provides the lowest amount of light and out of the three colours is the least perceivable to the human eye. The blue EL layer 6*b* is next as it emits a higher level of light than the red EL layer and is more perceivable to the human eye. The green EL layer 6*c* is furthest from the viewing area as it provides the largest amount of light output and is the most perceivable to the human eye. Although this is the colour layer configuration depicted in FIG. 15, other colour layer configurations may be used.

All of the EL layers 6*a*, 6*b*, 6*c* are transparent to some degree enabling the light to pass through any layer obscuring it. The layers are only coloured red, green and blue in the illustration as a way of diagrammatically depicting the design. The layers 6*a*, 6*b*, 6*c* will only emit light when excited and do not, in all cases, appear as the colour they represent when excited in any other state.

EL and UV Screen with Haptic Feedback

Figure 16:
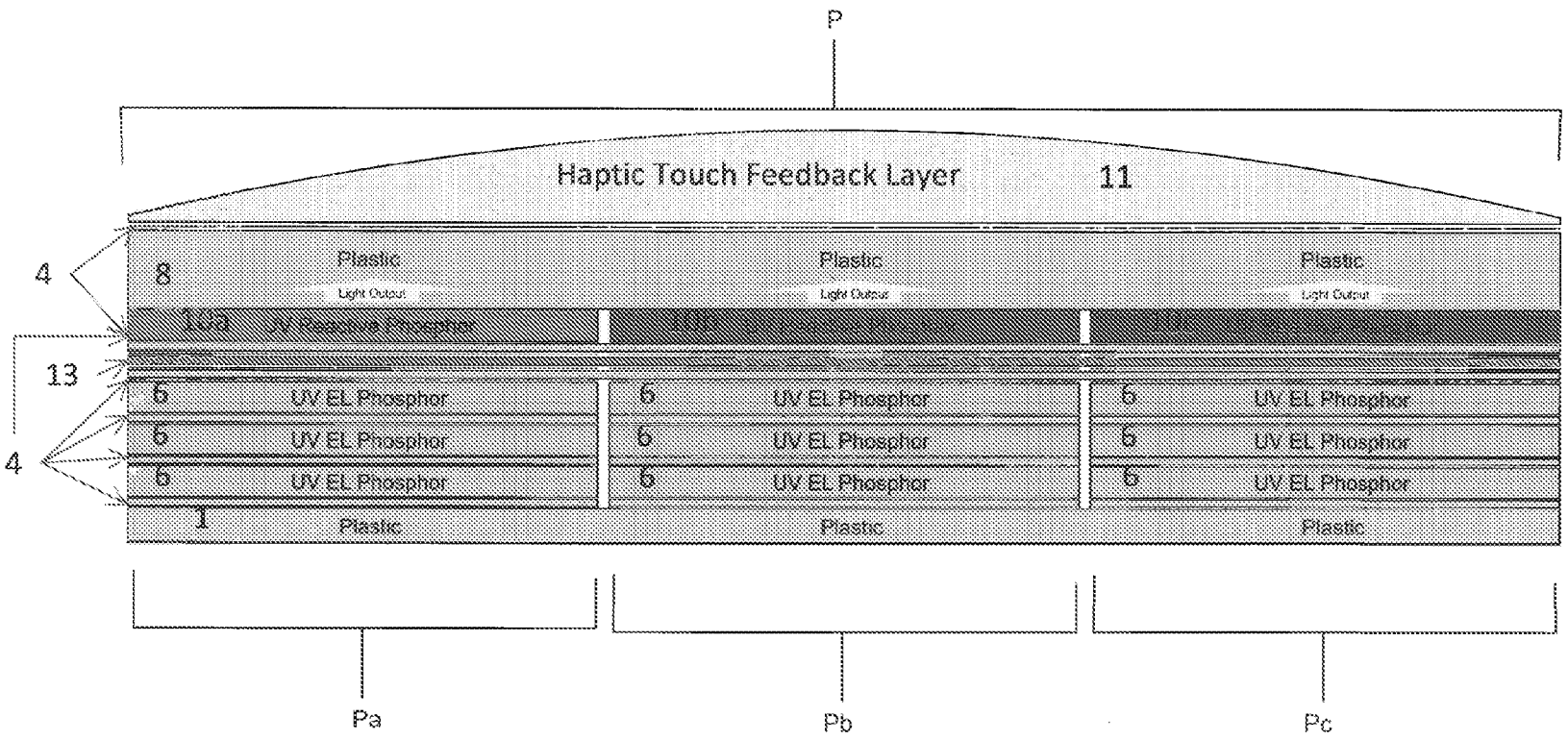
FIG. 16 is a schematic cross-sectional diagram of an electroluminescent colour pixel according to another embodiment.

FIG. 16 shows an embodiment similar to that of FIG. 14 with the variant of FIG. 13*a*; in other words, the embodiment comprises a plurality of coplanar sub-pixels Pa, Pb, Pc arranged to emit different colours, with each sub-pixel comprising a plurality of UV-emitting EL layers 6, and a UV fluorescent layer 10*a*, 10*b*, 10*c*.

In addition, a haptic touch feedback layer 11 is provided over the cover layer 8 of the pixel; this layer 11 comprises material that expands and contract rapidly when subjected to an electrical charge, making its surface differential detectable to a human finger, when in direct contact with surface of the haptic feedback layer 11. Transparent electronic circuit layers 4 are interleaved between the UV-emitting EL layers 6, and between the cover layer 8 and the haptic touch feedback layer 11.

A selective UV blocking layer 13, located between the UV fluorescent layer 10*a*, 10*b*, 10*c* and the UV-emitting EL layers, comprises a crystal substance that when excited in a specific way changes its state to block transition of UV light.

Alternatives to this embodiment may include the stacking of other electroluminescent light emitting systems and other UV light emitting electronic components that may constitute alternative and/or additional layers making up the active luminescent elements. Irrespective of this change in electroluminescent light emitting systems, the stacking of the EL elements multiplies the surface area multiplying the light output by the number of layers, less the losses imposed on the layer by the fact that they are not totally transparent.

EL and UV Screen with 3D Lenticular Output and Haptic Feedback

Figure 17:
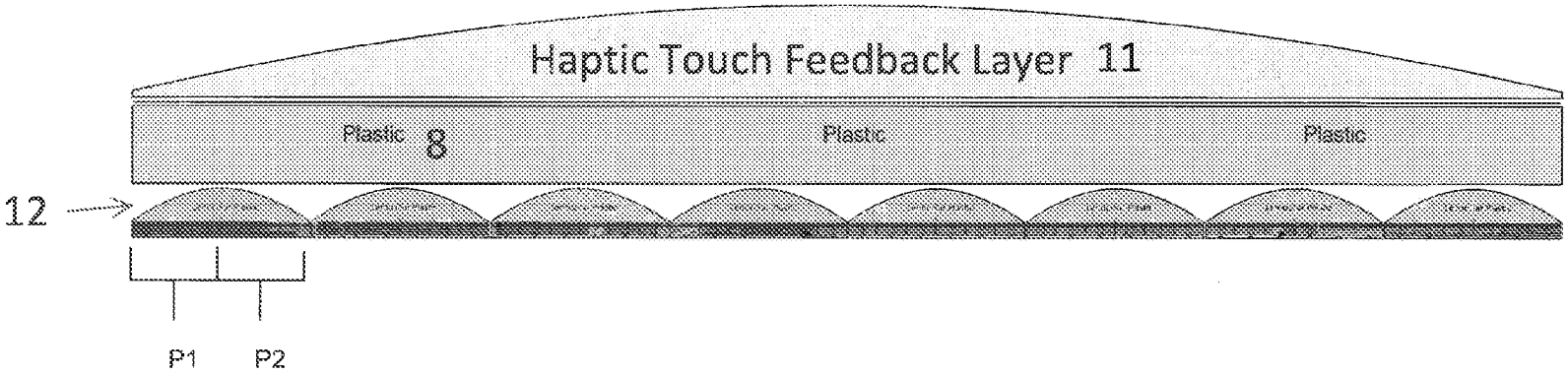
FIG. 17 is a schematic cross-sectional diagram of an electroluminescent lenticular colour display according to another embodiment.

Another embodiment shown in FIG. 17 comprises an array of colour pixels P, for example as described above in FIGS. 14 and 15, having a lenticular layer 12 arranged thereon comprising a plurality of lenses, each lens being aligned with a pair of pixels P1, P2 to create a 3D effect.

A haptic touch feedback layer 11 is arranged over the cover layer 8, which is arranged over the lenticular layer 12.

Increased Light Output—Nonplanar Layers

The following embodiments use nonplanar layers to increase the surface area of an EL element and/or array, and thereby increase the light output per overall area. For example, the surface of the substrate 1 may be embossed with a pattern before or after the EL layers 6 are applied, thereby significantly increasing the size and light output of any given area by placing multiple light emitting surfaces in a space that would normally be reserved for a single unit.

Figure 18B:
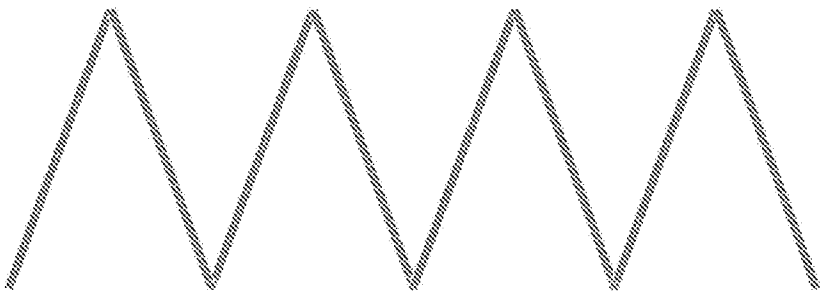
FIGS. 18*a* and 18*b* are comparative schematic examples of planar and non-planar EL layers.
Figure 18A:
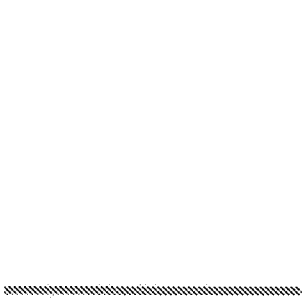

FIGS. 18*a* and 18*b* are comparative examples illustrating the advantages of these embodiments. FIG. 18*a* shows a flat EL layer 6 that would, for the purposes of this explanation, output lx=400 $m^2$, where:

$$1\ \text{lx}=1\ \text{lm/m}^2=1\text{cd}\cdot\text{sr}\cdot\text{m}^{-2}$$

If the pattern was embossed into the substrate 1 so that the pattern occupied the same space, as shown in FIG. 18*b*, the output of the element would be greatly increased to lx=3200 $m^2$. This process could be considered as being analogous to corrugated cardboard, where if the corrugated section of the board were to be laid out flat, it would have a larger surface area than a flat piece of cardboard of the same size. The pattern is illustrative and is not intended to restrict the use of other embossed patterns that will increase the surface area of the light emitting material and other such patterns are considered as being embodiments of the invention.

Figure 19:
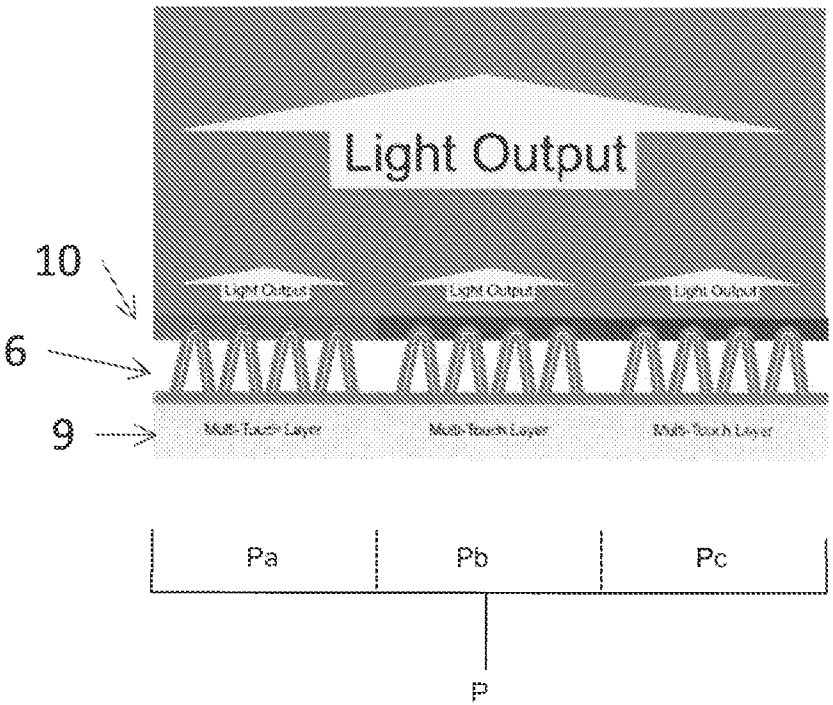
FIG. 19 is a schematic cross-sectional diagram of an electroluminescent colour pixel according to another embodiment.

FIG. 19 shows a digital colour pixel P in another embodiment, incorporating non-planar EL layers as described in the previous embodiments. The pixel P comprises coplanar sub-pixels Pa, Pb, Pc, each comprising one or more non-planar UV-emitting EL layers 6 and a fluorescent or phosphorescent layer 10 for emitting the respective sub-pixel colour when excited by the emitted UV.

A touch reactive surface 9, preferably a multi-touch reactive surface, is positioned behind the EL layers so as not to obstruct the viewing area, and may be incorporated as part of the embossed substrate 1.

Each section of the embossed EL layer 6 may be addressed individually and sub-elements of the embossed EL layer 6 may also be addressed individually, exciting only a section of the embossed pattern under each colour sub-pixel Pa, Pb, Pc.

Figure 20:
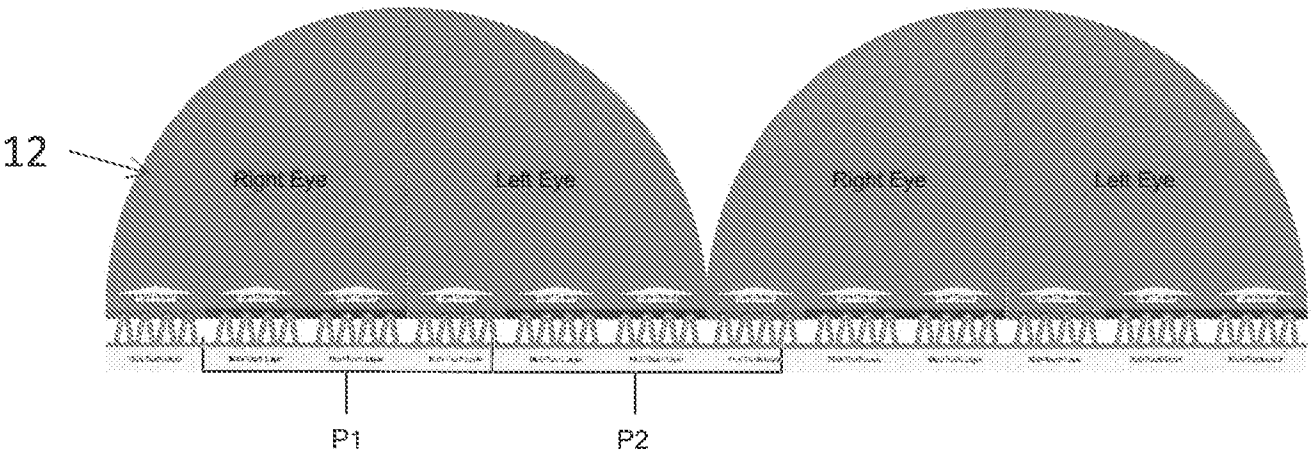
FIG. 20 is a schematic cross-sectional diagram of electroluminescent lenticular colour pixels according to another embodiment.

FIG. 20 shows a digital colour pixel array according to another embodiment, in which pairs of pixels P1, P2 each as shown in FIG. 18, are arranged under corresponding lenses 12 as in FIG. 17, to provide a different view to each eye so as to provide a 3D effect. The lenses 12 may be provided as a continuous lenticular layer. The fluorescent layer 10 may be formed directly on the underside of the lenticular layer 12 and the EL layer 6 may be formed directly on the touch reactive surface 9, and the two sections may then be bonded together to form a 3D digital display.

Double-Sided Electroluminescent Elements

The following embodiments comprise electroluminescent elements arranged to emit light from both sides.

Figure 21:
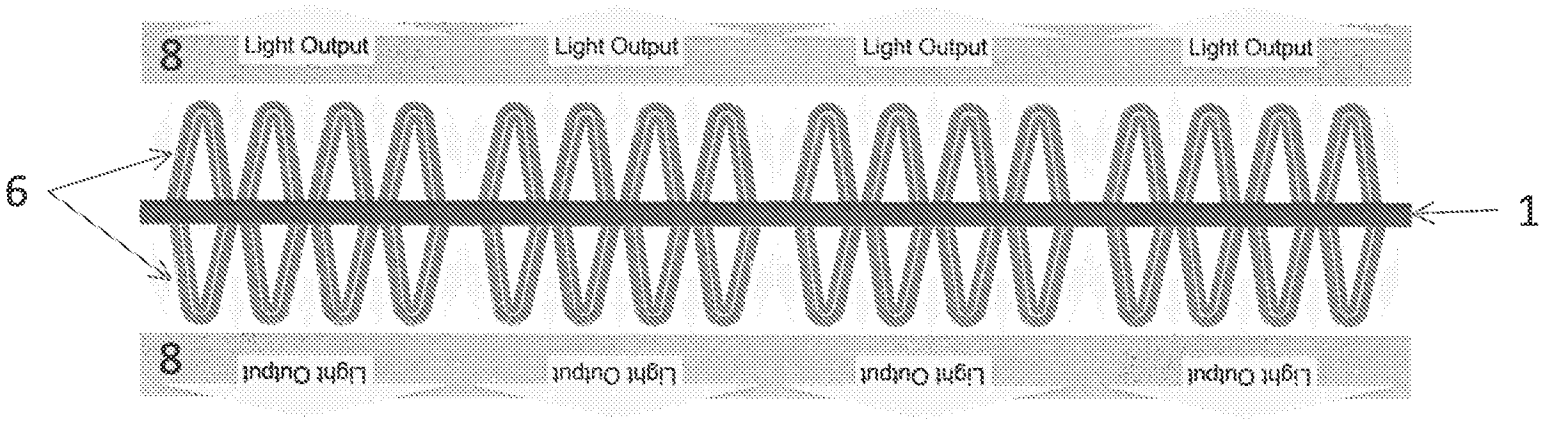
FIG. 21 is a schematic cross-sectional diagram of a double-sided electroluminescent array according to another embodiment.

FIG. 21 shows an embodiment in which EL layers 6, for example as in the third embodiment, are arranged on both sides of a central substrate 1, with a transparent or translucent cover layer 8 on either side. The EL layers 6 may be non-planar layers, as described above. As in the previous embodiments, electronic circuitry is provided to drive the EL layers, and may be supported by the central substrate 1.

An advantage of this configuration is that it can be deployed in many applications to provide strong, reliable and controllable light output with little generation of heat. Such applications may include replacements for conventional fluorescent light tubes. Alternative lighting could be formed into irregular shapes to illuminate specific form factors, with the light emitting units being manufactured in a wide variety of sizes.

Figure 22:
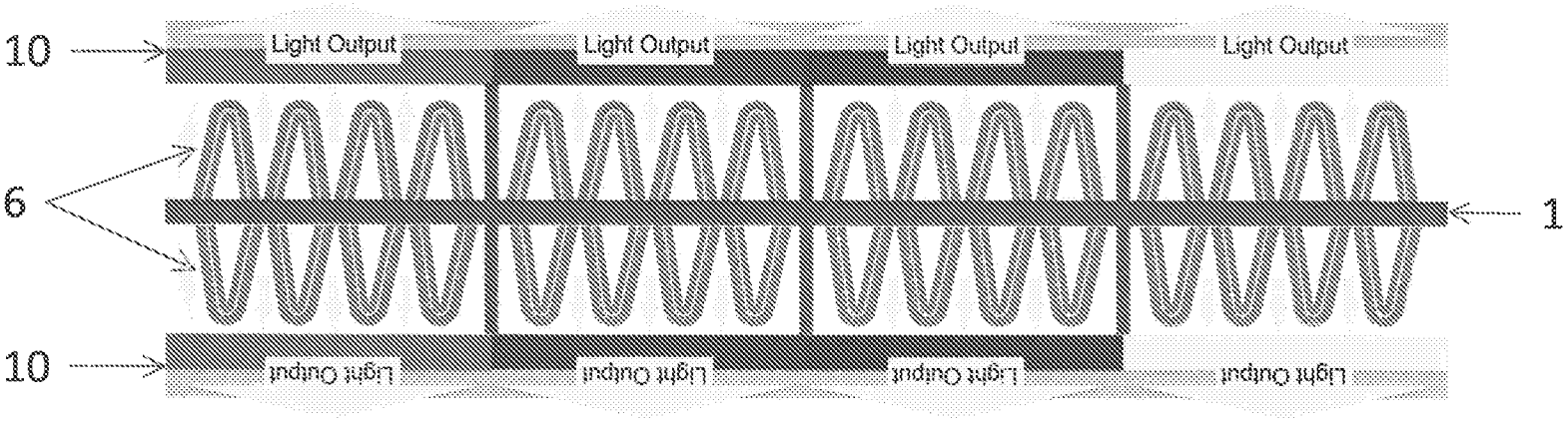
FIG. 22 is a schematic cross-sectional diagram of a double-sided electroluminescent colour pixel according to another embodiment.

FIG. 22 shows another embodiment, which is a variant of that of FIG. 21 as in the variant of FIG. 13*b*: the EL layers 6 are UV-emitting, and a UV-reactive fluorescent layer 10 is provided on each side, divided into sub-pixels of different colours. This embodiment is therefore suitable for a double-sided colour display, or a light source able to produce even illumination of a selected colour.

Figure 23:
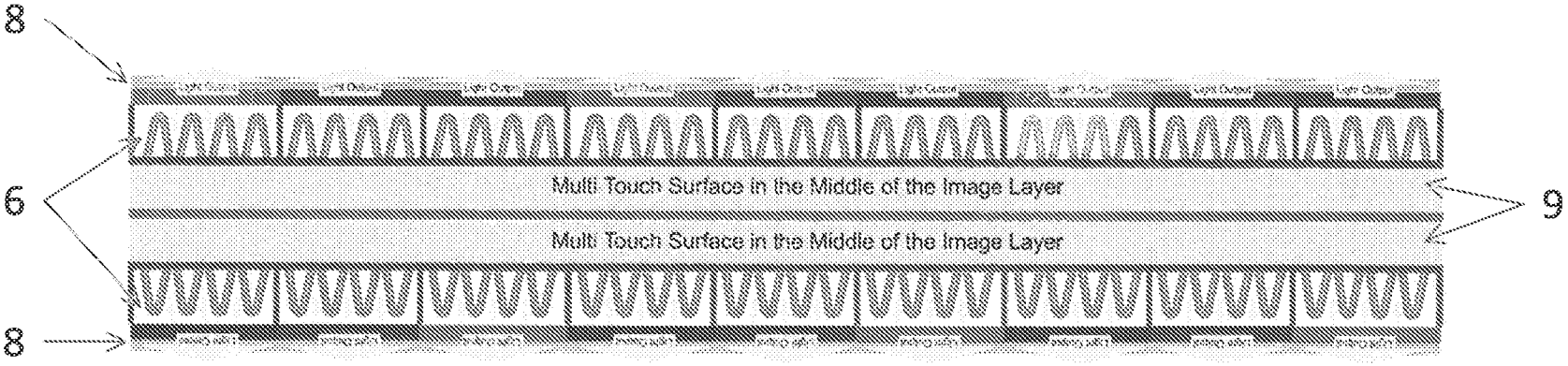
FIG. 23 is a schematic cross-sectional diagram of an array of double-sided electroluminescent colour pixels according to another embodiment.

FIG. 23 shows another embodiment, which is a variant of FIG. 22 in which a touch-sensitive surface 9 is provided on either side of the central substrate 1, beneath the EL layers 6. A digital display that is constructed in this way will be able to display different or the same images on each side. Both the touch surfaces can act independently or in conjunction with each other to provide a rich interactive experience. For example, an interactive input on one side may display an output result on the other side. Interactions from both sides may also evoke a result represented by a visual output on either of the display surfaces.

UV and EL Combination

Figure 24:
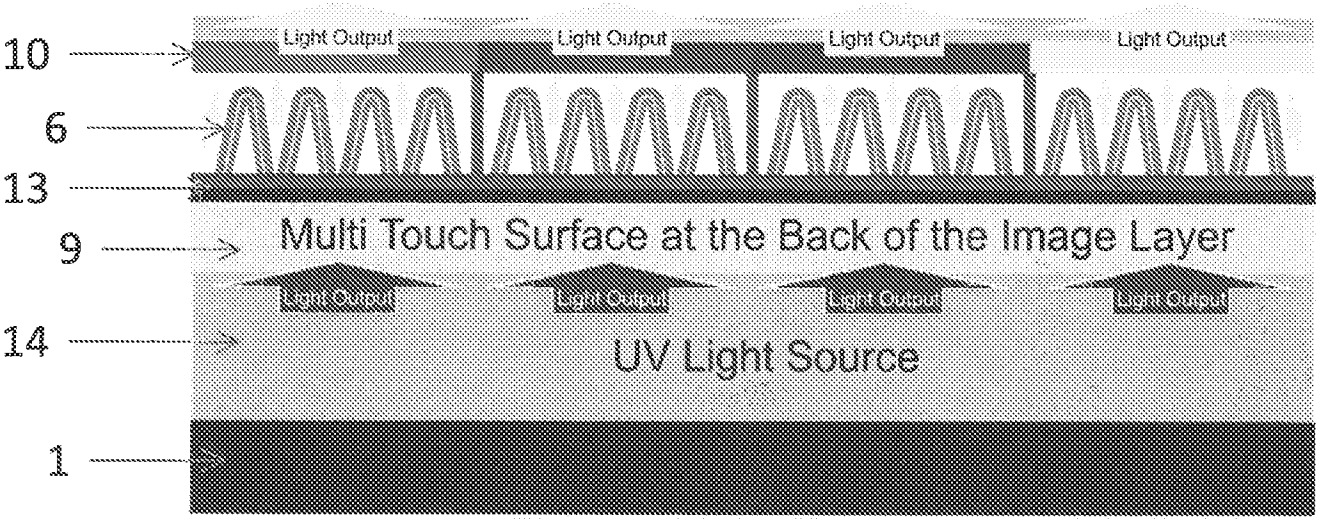
FIG. 24 is a schematic cross-sectional diagram of an electroluminescent colour pixel according to another embodiment.

FIG. 24 shows another embodiment in which a UV-emitting EL layer 14 is disposed on a substrate 1, and emits UV light through a touch-sensitive layer 9 and a selective UV blocking layer 13, comprising for example a crystal substance that when excited changes its state to block transmission of UV light, as in FIG. 16.

A non-planar UV-emitting EL layer 6, as described in the previous embodiments, is deposited on the UV blocking layer 13 and is arranged to excite a UV-reactive fluorescent layer 10, preferably arranged as sub-pixels of different colours.

Figure 25:
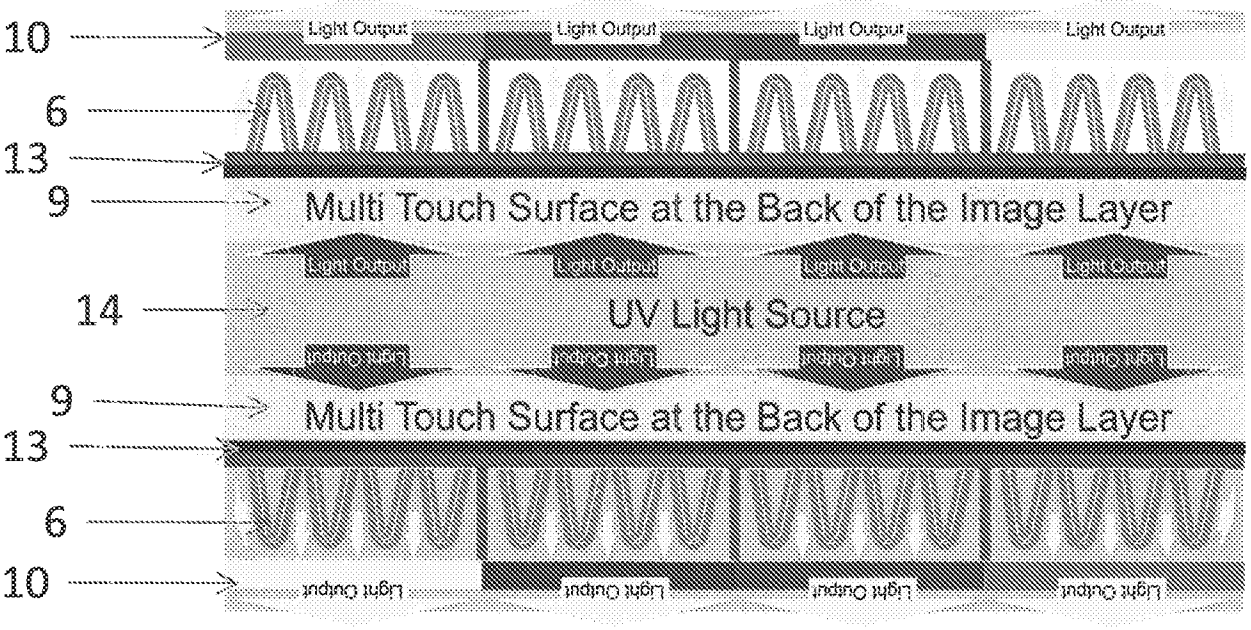
FIG. 25 is a schematic cross-sectional diagram of a double-sided electroluminescent colour pixel according to another embodiment.

FIG. 25 shows a double-sided variant of the embodiment of FIG. 24, in which the UV-emitting layer 14 comprises the central layer and may also act as a substrate.

Double-Sided Illumination

Figure 26:
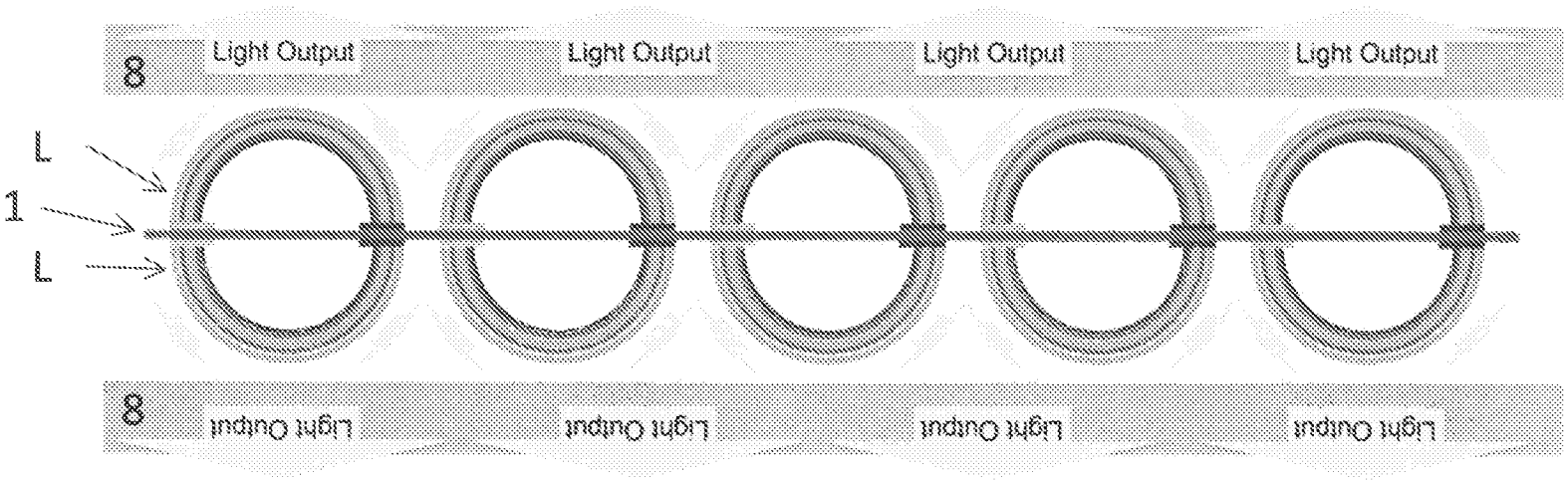
FIG. 26 is a schematic cross-sectional diagram of a double-sided electroluminescent light source according to another embodiment.

FIG. 26 shows an embodiment comprising a double-sided EL light source, in which a plurality of semispherical, semicylindrical or otherwise curved EL light emitting units or elements L are arranged on both sides of a central, preferably flexible substrate 1 so as to emit light in all directions, and are preferably protected by a cover 8 on either side, which may be a tubular cover. Each of the light-emitting units L may be constructed as in the embodiment of FIG. 13*a*, that is they comprise a plurality of EL layers emitting visible light. Optionally, the light-emitting units may include corrugated or embossed non-planar EL layers, as described above. The central substrate may include the electronic circuitry needed to connect and drive the light-emitting units L.

The advantage of this configuration is that the area of the light emitting spheres greatly increases the surface area of the EL units L, substantially increasing their light output. The construction of the light emitting spheres on a flexible centre substrate 1 that also contains the electronic circuits, and the ability to contain the light emitting construction in a flexible or non-flexible tube, means that maximum light output can be achieved in all directions and the system can be formed to fit almost any application.

Figure 27:
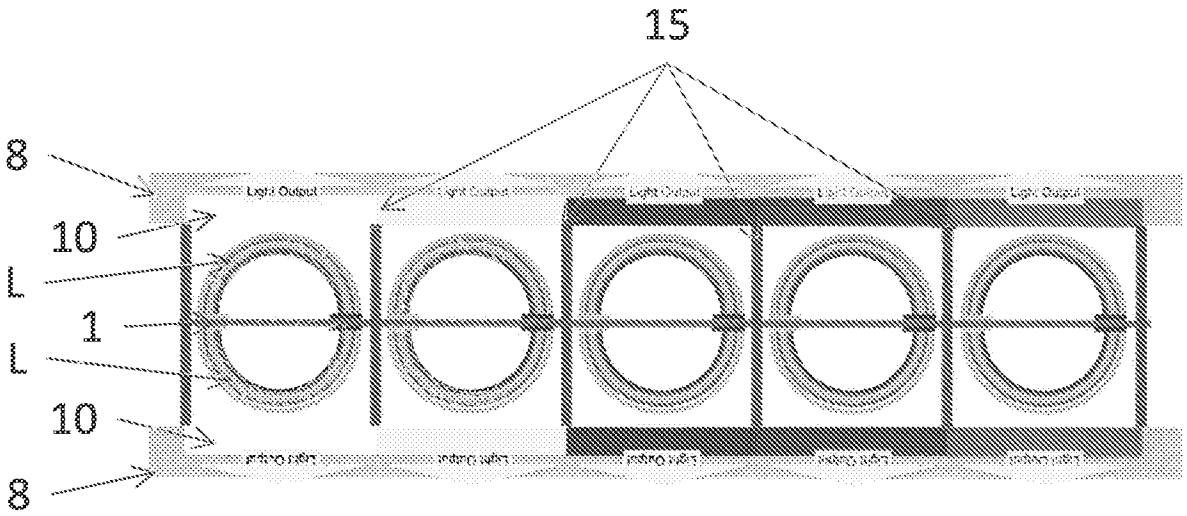
FIG. 27 is a schematic cross-sectional diagram of a double-sided electroluminescent light source according to another embodiment.

FIG. 27 shows a variant of the embodiment of FIG. 26, in that each of the light-emitting units L may be constructed as in the variant embodiment of FIG. 13*b*, that is they comprise a plurality of UV-emitting EL layers, and a separate fluorescent layer 10 is provided for each unit L, for emitting visible light when excited by the emitted UV light.

UV-blocking partitions 15 are provided between adjacent ones of the units, so that light from one unit L does not excite the fluorescent layer 10 of adjacent units L. In this way, each unit L and its corresponding fluorescent layer 10 may provide a discrete sub-pixel Pa, Pb, Pc.

Figure 28:
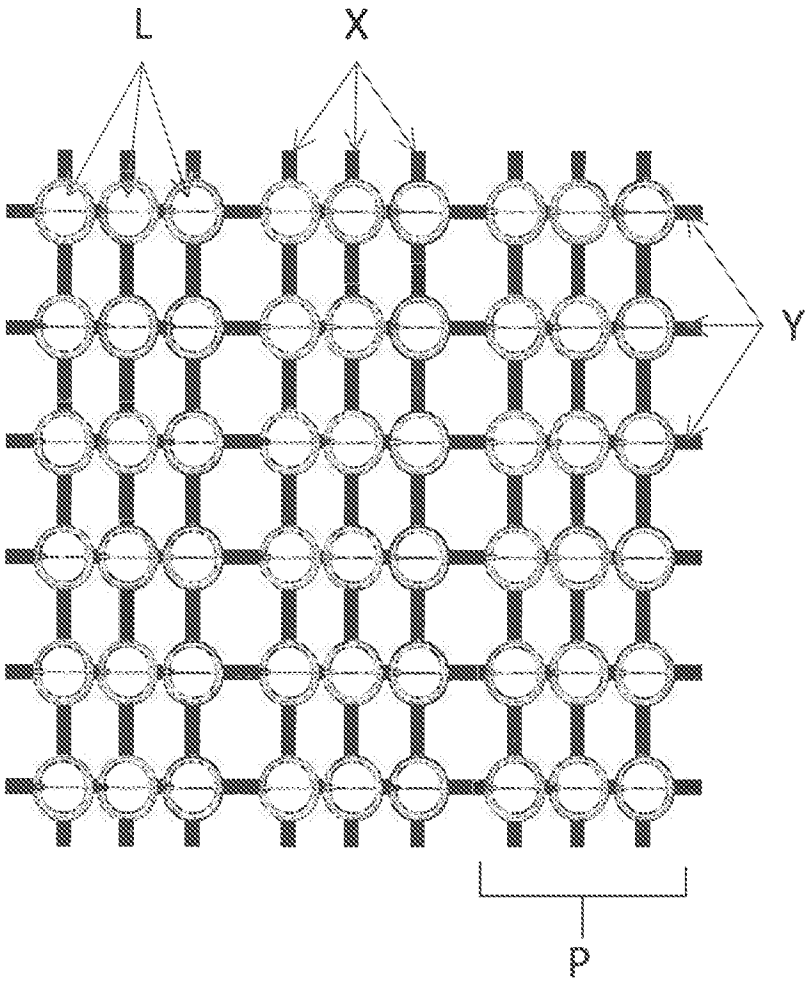
FIG. 28 is a schematic plan diagram of a two-dimensional display matrix according to another embodiment.

FIG. 28 is a plan view of a colour display matrix comprising a two-dimensional array of units L as shown in FIG. 27, with the units L arranged in groups of three for emitting respectively red, blue and green light, so as to comprise a colour pixel P. Electrical connections X and Y intersect at each unit L to provide addressing of each unit, and may also support the units L.

By grouping the spherical light emitting elements in the X and Y axes, a digital display can be constructed that has a high brightness and low power consumption. By extending the configuration in the Z axis, a volumetric display can be formed.

Figure 29:
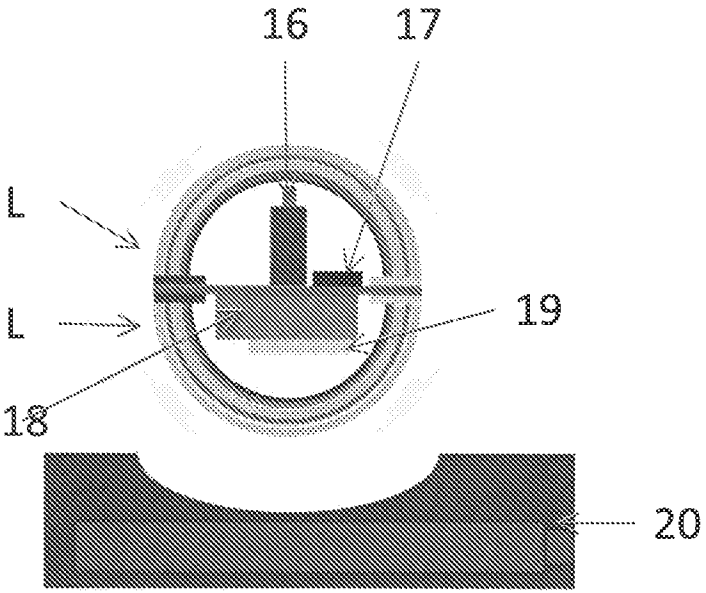
FIG. 29 is a schematic cross-sectional diagram of a rechargeable spherical light source according to another embodiment.

FIG. 29 shows an embodiment comprising a rechargeable EL light source, formed of a pair of EL units L as described above, formed together as a sphere. Within the sphere are provided an ON/OFF switch 16, control electronics 17, in the form of an integrated circuit, an electromagnetic charging coil 18, and a rechargeable power cell 19. A charging base 20, including an electromagnetic charging coil, may be used to recharge the power cell 19 via the charging coils. As the light emitting units L and their driving electronics are completely encapsulated and emit very low amounts of heat, and because light is emitted in all directions, this EL light source can be used in many applications, including ones that are underwater.

EL Capacitor Lighting

Figure 30C:
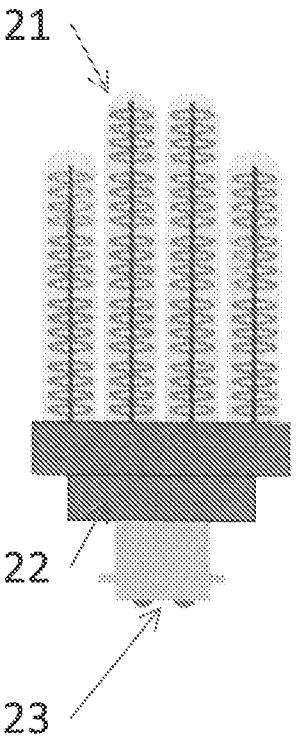
FIGS. 30*a* to 30*c* are schematic illustrations of replaceable light sources incorporating embodiments of the invention.
Figure 30B:
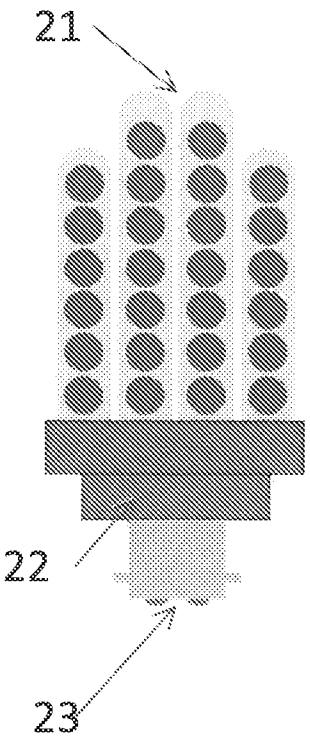
Figure 30A:
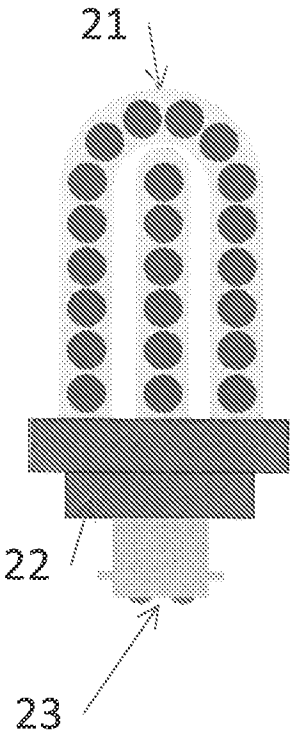

FIGS. 30*a*, 30*b* and 30*c* show replaceable light sources or 'bulbs' incorporating EL units or elements as described above, packaged in transparent tubes 21 connected to a housing 22 containing the driving electronics for the EL units, and to a plug fitting 23 complying to the standard of the country for which the replaceable light source is intended.

Similar replaceable light sources, such as light tubing and filament based lights, could also be replaced by the above light sources, with the external configuration looking very much like its currently used counterpart.

Figure 31B:
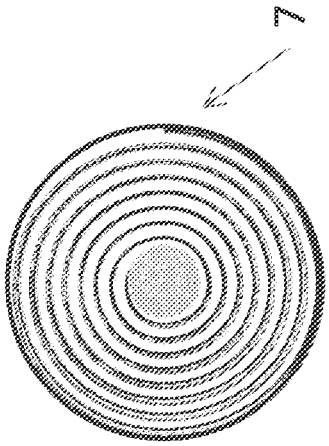
FIGS. 31*a* and 31*b* are schematic cross-sections and plan views respectively of a light source in another embodiment of the invention.
Figure 31A:
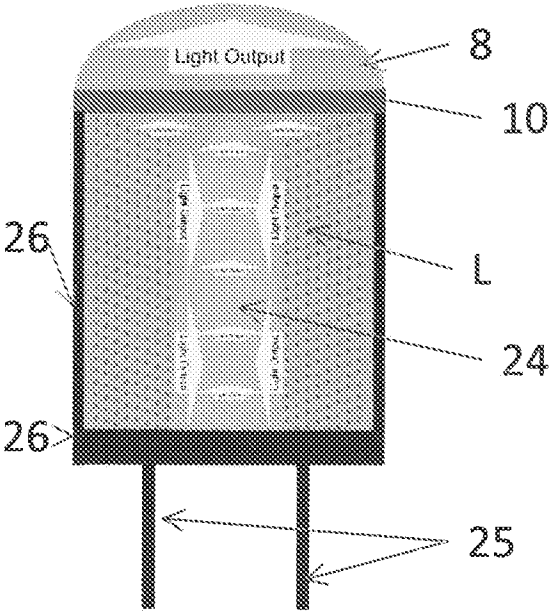

FIGS. 31*a* and 31*b* are respectively cross-sectional and plan schematic views of an EL light source intended to replace an LED (Light Emitting Diode) package. Within the light source, an EL unit L is formed of spiral layers (as best shown in FIG. 31*b*) arranged around a central core 24 that acts as a light guide to collect and direct the light through a coloured transparent coating, or a fluorescent layer 10, on which is located a cover 8 comprising a protective lens configured to concentrate the light output. Connectors 25 provide electrical connections to the EL unit L, while a protective outer coating seals the light emitting unit L.

Figure 32:
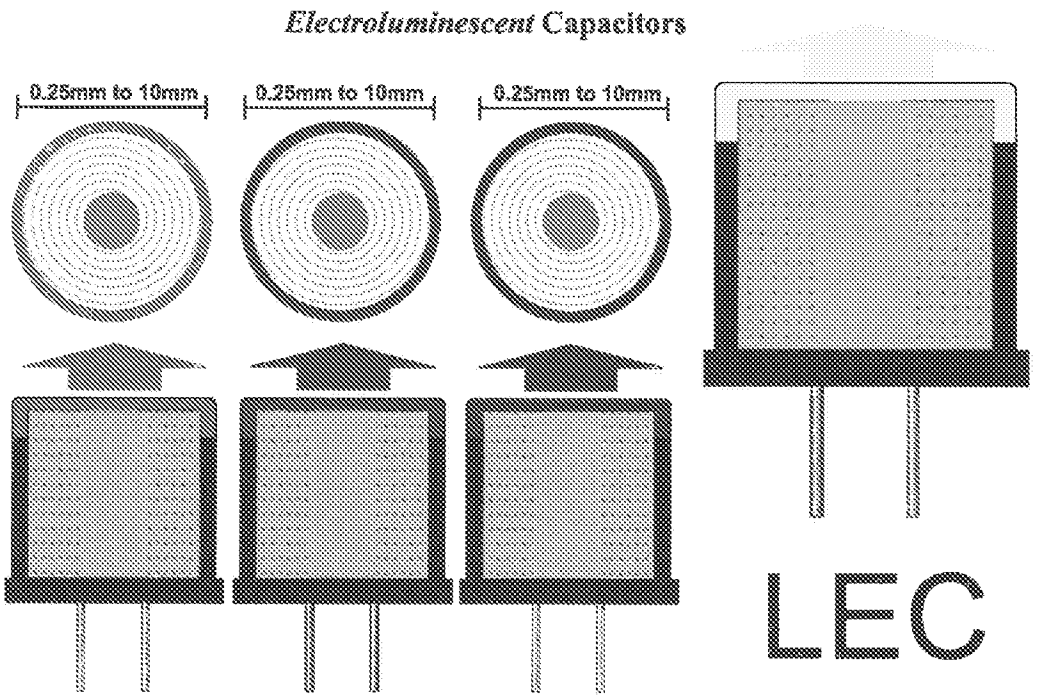
FIG. 32 is a schematic diagram of a group of light sources, each as in FIGS. 31*a* and 31*b*.

As shown in FIG. 32, a group of light sources according to FIGS. 31*a* and 31*b*, each of a different colour, may be arranged as subpixels to form a colour pixel, for example for a large scale display. The diameter of each light source may be in the range 0.25 to 10 mm.

Alternative Embodiments

The configurations described above may be configured as follows:

- Multi-touch surfaces that are non-uniform, in both their edge or their surface, such as the contour on a car dashboard or an outer surface of a toy.
- Banner signage, that has the controlling electronics either at the top or bottom edge, and is designed to have a flexible display area that is hung against a wall, or left to move freely when hung from a pole or other structure.
- Cylindrical configurations: signage that is wrapped around a pillar or free standing, where the display area is presented in cylindrical configurations so as to utilise the area all the way round.
- Beads: a digital display unit that is made up of a plurality of spherical light emitting units that are connected together so that the individual spheres can be address by a controller unit. The spherical light emitting units are then addressed to form pictures, even when the spherical light emitting units are free flowing.
- Inverted image displays: a digital display that is contoured and inverted so that the image is projected onto a second or multiple surfaces so that it can be viewed in conjunction with other items that are already being viewed on or through that surface.
- Electromagnetic powered: an EL device that is powered by a signal being transferred from one component attached to the device and a second attached to its charging unit. Energy is transferred from one to the other without the need for physical contact to be made.
- Multi surface, multi gesture mobile devices: a device that is encased in the EL multi-touch surfaces that are described above. It is proposed that two or more of the surfaces are covered and will react in sympathetic ways to perform a function and change the display characteristics, effectively turning the total surface, back front and sides into a multi-interactive display area.
- Floor tiles: devices that can be placed individually or as a group, where when placed alone would act as an individual unit and display its own digital images and react to input provided to it by either interaction by a person or information sent to it from a transmitting device. When placed in proximity to each other, devices would lock together and act as one unit, with the capability of displaying a single image over the one shared area. In the event that the devices are to display the same image shared across their area or individual images that are designed to work together, the units would be provided with this information from the master transmitting device. The devices would be able to transmit information between themselves in a group so that user based input could be relayed to the other devices in the group. Direct interaction with mobile devices is envisaged through a mobile application, providing user input and then transmitting it to the tile display device unit. The devices may also have an optical device that would be able to read movement and other optical input. The devices would also have movement and pressure sensors.
- Disposable and reusable packaging displays: a cover that incorporates the EL configurations as described above, that is designed for a product to fit into so that when the product is on sale it can interactively attract attention to itself and display many sets of static and non-static information. The container can be charged (wired or by wireless frequency) when placed on a shelf surface and can have information sent to it wirelessly. Upon purchase of the product, the outer digital display unit can be removed and the reused for the same product, or reprogrammed and used for some other product.
- Revolving Electroluminescent Capacitor Displays: a display made up of 2 and 4 vertically aligned EL light sources, as disclosed above. The array of EL light sources would spin inside an encapsulated unit displaying a 2 or 3 dimensional image. The rotating units containing the 2 and 4 vertically aligned EL light sources may also have inner 2 and 4 vertically aligned EL light sources also displaying images and used in conjunction with each other.
- EL Lettering: This unit is an electroluminescent capacitor lettering that consists of a number of fonts produced using the EL structures contemplated in this document, whereas the symbols consist of the EL system, driver electronics, a rechargeable power cell and one side of an electromagnetic wireless charging system. The display board consists of the second side of the electromagnetic wireless charging system, a magnetic surface and power supply. Each symbol can be individually addressed by a control signal sent to it.

Although the above embodiments may use non-organic systems, it may also be possible to create the same or similar configurations using OLED, LED or other systems, and the present invention may extend to the construction of the light emitting unit regardless of the light emission system used.

The above embodiments are described by way of example, and alternative embodiments which may become apparent to the skilled person on reading the above description may nevertheless fall within the scope of the claims.

The invention claimed is:

1. A double-sided electroluminescent element arranged to emit light in mutually opposite directions, wherein the electroluminescent element comprises:

i. a central common substrate, ii. a non planar electroluminescent material layer formed on both sides of the substrate, and iii. a transparent or translucent cover layer on either side of the electroluminescent material layer, through which light is output;

wherein the electroluminescent material layer is arranged on one or both sides of the substrate to emit ultraviolet light, the element further including an ultraviolet reactive layer arranged to emit visible light.

2. The electroluminescent element of claim 1, wherein the non planar electroluminescent material layer is corrugated or embossed.

3. The electroluminescent element of claim 1, wherein the electroluminescent material layer comprises electroluminescent particles in suspension.

4. An electroluminescent array of different colored electroluminescent pixels comprising a plurality of individually addressable elements each as claimed in claim 1, wherein the electroluminescent elements are of mutually different colors, the colors comprising red, blue and green.

5. The electroluminescent element of claim 1, further including a touch sensitive or reactive layer positioned behind the electroluminescent material layer.

6. A lenticular 3D display comprising an array of colored electroluminescent pixels according to claim 4, and a lenticular layer aligned with the color pixels so as to provide a 3D display.

7. The electroluminescent element of claim 1, wherein the cover layer is an outermost layer of at least one side of the electroluminescent element.

* * * * *